United States Patent [19]

Mandell et al.

[11] Patent Number: 5,046,098

[45] **Date of Patent: * Sep. 3, 1991**

[54] VARIABLE MATRIX DECODER WITH THREE OUTPUT CHANNELS

[75] Inventors: Douglas E. Mandell, Sausalito; Craig C. Todd, Mill Valley; Roger Dressler, Martinez, all of Calif.

[73] Assignee: Dolby Laboratories Licensing Corporation, San Francisco, Calif.

[ * ] Notice: The portion of the term of this patent subsequent to Jan. 17, 2006 has been disclaimed.

[21] Appl. No.: 359,970

[22] Filed: Jun. 1, 1989

Related U.S. Application Data

[63] Continuation-in-part of Ser. No. 708,982, Mar. 7, 1985, abandoned, and a continuation-in-part of Ser. No. 833,120, Feb. 26, 1986, Pat. No. 4,799,260, and a continuation-in-part of Ser. No. 222,847, Jul. 22, 1988.

[51] Int. Cl.[5] ..... H04S 3/00

[52] U.S. Cl. ..... 381/22

[58] Field of Search ..... 381/23, 19, 20, 21, 381/22

[56] References Cited

U.S. PATENT DOCUMENTS

| | | |
|---|---|---|
| 1,328,141 | 8/1920 | Scheiber . |
| 3,170,991 | 2/1965 | Glasgal . |
| 3,176,072 | 3/1965 | Novak . |
| 3,632,886 | 1/1972 | Scheiber . |
| 3,708,631 | 1/1973 | Bauer et al. . |
| 3,746,792 | 7/1973 | Scheiber . |

(List continued on next page.)

FOREIGN PATENT DOCUMENTS

| | | |
|---|---|---|
| 2345296 | 3/1974 | Fed. Rep. of Germany . |
| 2130306 | 3/1972 | France . |
| 53-138301 | 12/1978 | Japan . |
| 61-9800 | 6/1986 | Japan . |
| 1586271 | 3/1981 | United Kingdom . |

OTHER PUBLICATIONS

"Analog Signal Processor IC's for Sound Field Effects", Ishikawa et al., International Conference on Consumer Electronics, Chicago, Jun. 9, 1988.

Field Bulletin 159, "Sanyo LA2770 Integrated Circuit for Dolby Pro Logic Surround Decoding", Dolby Laboratories Licensing Corp., Aug. 1988.

Signal Processing in the SQ Logic System, J. E. Hanna, vol. CE-No. 2, May 1976, New York.

"Four Channels and Compatibility", by Peter Scheiber, *Journal of the Audio Engineering Society*, Apr. 1971, vol. 19, No. 4, pp. 267-279.

"Surround Sound in the Eighties—Advances in Decoder Technology", by Martin E. G. Willcocks presented at the 74th Convention of the Audio Engineering Society, Oct. 83, N.Y.

*Primary Examiner*—Forester W. Isen

*Attorney, Agent, or Firm*—Majestic, Parsons, Siebert & Hsue

[57] ABSTRACT

The decoder of this invention decodes at least two channel signals in a directional information system where one or more input signals containing directional information have been encoded into the two or more channel signals. The decoder generates a first control signal substantially proportional to the logarithm of the ratio of the amplitudes of two of the channel signals to detect, as between two of the channel signals, whether the amplitude of one signal dominates that of the other. The decoder also generates a second control signal substantially proportional to the logarithm of the ratio of the amplitudes of the sum and the difference between two of the channel signals to detect the dominant signal in terms of amplitude. The decoder includes a matrix means responsive to the two or more channel signals and the two control signals for generating a number of output signals according to an algorithm. The control signals generated are used to steer the directional information systems in such manner through the matrix means that the directional effects of the output signals are enhanced. The matrix means generates three directional control signals from the two control signals.

23 Claims, 10 Drawing Sheets

U.S. PATENT DOCUMENTS 3,783,192 1/1974 Takahashi .
3,784,744 1/1974 Bauer .
3,786,193 1/1974 Tsurushima .
3,794,780 2/1974 Bauer et al. .
3,794,781 2/1974 Bauer .
3,798,373 3/1974 Bauer .
3,812,295 5/1974 Bauer .
3,821,471 6/1974 Bauer .
3,825,684 7/1974 Ito et al. .
3,829,615 7/1974 Hiramatsu .
3,836,715 9/1974 Ito et al. .
3,864,516 2/1975 Kameoka et al. .
3,885,101 5/1975 Ito et al. .
3,887,770 6/1975 Takahashi .
3,889,061 6/1975 Ito et al. .
3,892,918 7/1975 Takahashi et al. .
3,934,086 1/1976 Takahashi ..... 381/22
3,944,735 3/1976 Willcocks .
3,947,637 3/1976 Seki et al. .
3,952,157 4/1976 Takahashi et al. .
3,959,590 5/1976 Scheiber .
3,967,063 6/1976 Bauer .
4,018,992 4/1977 Olson .
4,063,032 12/1977 Willcocks .
4,704,728 11/1987 Scheiber ..... 381/22
4,799,260 1/1989 Mandell et al. ..... 381/22

VARIABLE MATRIX DECODER WITH THREE OUTPUT CHANNELS

RELATED APPLICATIONS

This application is a continuation-in-part application of Ser. No. 06/708,982, filed Mar. 7, 1985, now abandoned, Ser. No. 833,120, filed Feb. 26, 1986, now U.S. Pat. No. 4,799,260 and Ser. No. 222,847, filed July 22, 1988.

BACKGROUND OF THE INVENTION

This invention relates to a directional information system where a number of input signals are encoded for recording or transmission on a medium into two or more channel signals and where the channel signals are decoded into a number of output signals corresponding to the directional information input signals. The decoder of this invention decodes the two or more channel signals so that directional effects are enhanced.

In quadraphony the loudspeakers are spaced horizontally around the listeners in four locations, to create an impression of the original program in full horizontal surround sound. In some quadraphonic systems the loudspeakers are placed at the four corners of the room. In other quadraphonic systems, such as those used in motion picture theaters, loudspeakers are not all placed at corners. Instead they may be placed at the left and right front corners of the theater, at the center of the front stage and dispersed around the back wall of the theater. The loudspeakers placed at the front left and right corners are still known as the left and right speakers; the ones placed at the center of the front stage known as the center speakers; and those at the back wall as the surround speakers. In order for the recording played back through the loudspeakers to recreate a realistic impression of the original program, the recording must contain directional information. In some quadraphonic systems four discrete input channels are actually recorded; this is known as the 4-4-4 format. The other general approach, termed 4-2-4, uses some kind of matrix encoding of the four audio input channels into two channels such as two conventional stereo-recorded channels, which are decoded back to four audio output channels during playback.

In the 4-2-4 sound systems, since the four directional audio input signals are transformed into two channel signals by the encoder, some directional information will be lost so that it is impossible for the decoder to reproduce signals perfectly identical to the original directional audio input signals. As a result, the cross-talk between adjacent channels and the reproduced sound signal may greatly reduce the directional effect of the quadraphonic system.

Numerous attempts have been made to enhance the directional effects of quadraphonic 4-2-4 systems. In one approach known as gain riding, the net sound level of each of the four loudspeakers is adjusted without adjusting the relative contributions of the two channel signals to reduce cross-talk. In another approach known as the variable matrix approach, the four output signals fed to the four loudspeakers are derived by certain mathematical computations performed on the two channel signals to vary the relative contributions of the two channel signals in order to reduce the effect of cross-talk.

Ito et al., in U.S. Pat. No. 3,825,684, disclosed a variable matrix decoder for enhancing the directional effects of a four channel playback system with loudspeakers placed at the four corners of the room. The decoder has a control unit which detects the phase difference between the two channel signals and produces two control signals, one for controlling the separation of the two front outputs and the second control signal for controlling the separation of the two rear outputs. The two control signals are also used to control the level of the front output signals relative to the rear output signals. In reference to FIG. 10 of U.S. Pat. No. 3,825,684, for example, the separation between the two front outputs is controlled by the gain f applied by variable amplifier 122 and appears to vary inversely with the magnitude of the phase difference between the two channel signals L and R. The separation between the two rear outputs is controlled by the gain b of variable amplifier 127 and appears to vary directly with the magnitude of the phase between L and R.

In U.S. Pat. No. 3,944,735, Willcocks discloses a directional enhancement system used together with existing matrix decoders and for enhancing the directional effects of output signals from these decoders. It does not include a 2-4 matrix decoder as such. Instead the system modifies the four output signals obtained from a preceding quadraphonic matrix decoder to enhance the directional content of the signals before presenting them to the loudspeakers. The system comprises a detector which generates 6, 8 or 10 directional control signals by comparing envelopes of certain signals derived by fixed matrices from the channel signals. The detector generates these control signals using automatic gain control to avoid dependence on signal levels. Willcocks employs a processor which generates from the control signals the coefficients of a modifying matrix, and employs a matrix modifier which modifies the four output signals of the preceding matrix decoder by the modifying matrix.

None of the above directional enhancement systems for 4-2-4 quadraphonic decoders is entirely satisfactory. It is therefore desirable to provide systems with better directional enhancement capabilities and with simpler circuitry.

SUMMARY OF THE INVENTION

The decoder of this invention decodes at least two channel signals in a directional information system where one or more input signals containing directional information have been encoded into the two or more channel signals. The decoder includes a first means for generating at least a first dominance signal indicative of the ratio of the amplitudes of a pair of the channel signals. In the preferred embodiment, the first dominance signal is substantially proportional to the logarithm of the ratio of the amplitudes of a pair of the channel signals. The first generating means of the decoder thus detects, as between the pair of channel signals, whether the amplitude of one signal dominates that of the other. The decoder also includes a second means for generating at least a second dominance signal indicative of the ratio of the amplitudes of the sum of and difference between the pair of channel signals. In the preferred embodiment, the second dominance signal is substantially proportional to the logarithm of the ratio of the amplitudes of the sum and the difference between said pair of channel signals. The second generating means detects, as between two signals, one being equal to the sum of the pair of channel signals and the other being equal to the difference between them, whether the amplitude of one signal dominates the other. The decoder further includes a matrix means responsive to the two or more channel signals and the at least two dominance signals from the two generating means for generating a number of output signals. Thus, if the first generating means or the second generating means detects the dominance of one channel signal over another or the dominance of the amplitude of the sum of these channel signals over their difference, or vice versa, the dominance signals generated are used to steer the directional information systems in such manner through the matrix means that the directional effects of the output signals are enhanced.

By detecting the dominance between pairs of channel signals and between the sum of and the difference between the two signals in each of these pairs a ratios between their amplitudes, the detection capability of the decoder is not tied to a set reference level; hence, the decoder is capable of detecting the directional information in the two or more channel signals as described above even at very low signal levels. By detecting the dominance between pairs of signals in the form of the logarithms of the amplitude ratios, such dominance can be conveniently expressed in decibels. The matrix means includes means for deriving three directional control signals $E_L$, $E_R$ and $E_C$.

DETAILED DESCRIPTION OF THE PREFERRED EMBODIMENT

This invention is directed towards variable matrix decoders having three output channels and decoders which can provide three or four output channels. The decoder of this invention bears certain similarities to the four output channel decoder of parent applications Ser. No. 06/708,982, filed Mar. 7, 1985, now abandoned, Ser. No. 833,120, filed Feb. 26, 1986, now U.S. Pat. No. 4,799,260 and Ser. No. 222,847, filed July 22, 1988. The description of the four output channel decoder in the parent applications is set forth below to assist the illustration of the invention.

Figure 1:
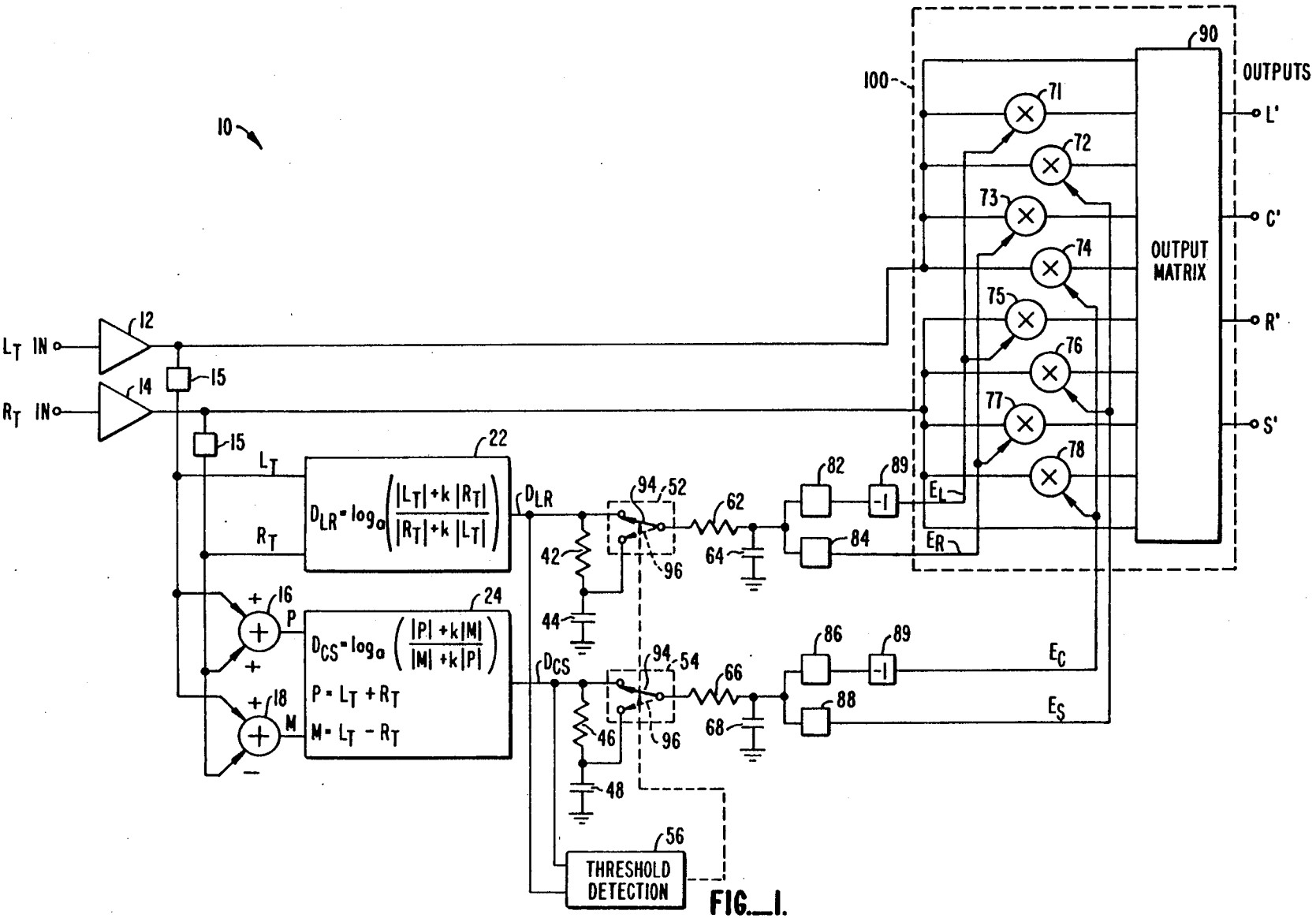
FIG. 1 is a block diagram of a decoder system illustrating a four output channel decoder.

FIG. 1 is a block diagram of a variable matrix decoder for enhancing the directional effects of the decoded signals to illustrate the invention. As shown in FIG. 1, the decoder 10 comprises buffers 12, 14, summers 16, 18 and differential logarithmic converters 22 and 24. The two signals $L_T$ and $R_T$ are two channel signals derived in an encoder (not shown) from four signals in such manner that the two channel signals contain directional information related to the directions of the four input signals. The preferred embodiment described herein responds best where four input signals, L, C, R, and S have been encoded such that L signals are carried by $L_T$, R signals by $R_T$, $L_T+R_T$ signals by in-phase components in $L_T$ and $R_T$, and $L_T-R_T$ signals by out-of-phase components in $L_T$ and $R_T$. For convenience in discussion, $L_T+R_T$ signals are referred to below as P signals, and $L_T-R_T$ signals as M signals.

Figure 5A:
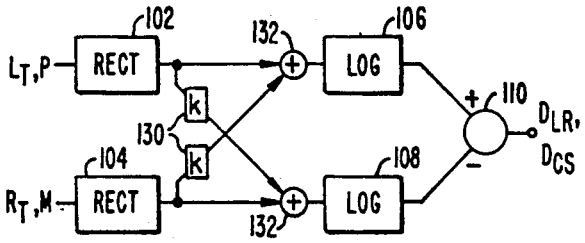
FIGS. 5A and 5B are respectively a block diagram and a schematic circuit diagram illustrating two alternative circuits for the providing the logarithm of the ratio of the amplitudes of two signals.
Figure 5B:
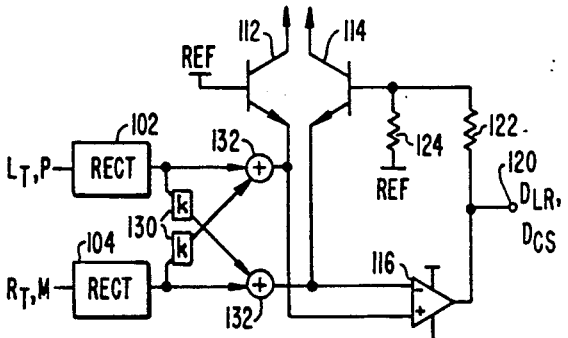

As shown in FIG. 1, the two channel signals are applied through buffers 12, 14, band pass filters 15 and then applied to differential logarithmic converter 22 (in which the filtered signals are rectified by rectifiers 102, 104 as shown in FIGS. 5A, 5B). A small fraction k of the magnitude of signal $L_T$ is added to the magnitude of $R_T$, and a small fraction k of the magnitude of signal $R_T$ is added to the magnitude of $L_T$. The value of $D_{LR}$ is computed according to the expression in block 22. The reason for intentionally introducing small crosstalk signals will become clear below.

After filtering, the channel signals are also applied to summers 16, 18 where summer 16 provides an output P equal to the sum of the two channel signals, and where summer 18 provides an output M equal to the difference between the two channel signals and then applied to the logarithmic converter 24. A small fraction k of the magnitude of signal M is added to the magnitude of P and a small fraction k of the magnitude of signal P is added to the magnitude of M. The value of $D_{CS}$ is then computed according to the expression in block 24.

Converters 22 and 24 provide outputs $D_{LR}$ and $D_{CS}$ respectively. For the purpose of discussion, the small crosstalk signals introduced are ignored for now. Thus, the output signal $D_{LR}$ is the logarithm to base a, a being a constant, of the ratio of the amplitudes of $L_T$ to $R_T$ and $D_{CS}$ being equal to the logarithm to base a of the ratio between the amplitude difference M. The signals $D_{LR}$ and $D_{CS}$ measure in terms of amplitudes the dominance between $L_T$ and $R_T$ and between their sum and difference, and are referred to below as the dominance signals.

When one of the signals $R_T$, M becomes very small, one or more of the dominance signals, being logarithmic ratios with $R_T$ and M in the denominators, may theoretically become very large. As a practical matter, however, noise is present in most decoder media. Such noise is added to the signals $R_T$, M in the denominators of the ratios to determine the dominance signals $D_{LR}$, $D_{CS}$. In other words, the noise present in the decoder system determines the directional steering characteristics of the decoder. Since such noise may be random, the steering characteristics become controlled by random factors which is undesirable. The same is true if the signals $L_T$, P are very small. To avoid such undesirable random steering, small crosstalk signals are purposely introduced. Hence, when $L_T$, $R_T$, P or M is small, the corresponding dominance signal is close to the ratio $\pm\log_a k$. A value of k of about 0.1 may be satisfactory.

Resistor 42, capacitor 44 form a delay or averaging circuit for signal $D_{LR}$; resistor 46 and capacitor 48 form a delay or averaging circuit for signal $D_{CS}$. The two delay circuits are switched on or off by switches 52, 54 which are controlled by a threshold detection circuit 56. The functions of these delay circuits, switches and threshold circuit will be described below after the operation of decoder 10 has been described. Resistor 62 and capacitor 64 form a smoothing circuit for signal $D_{LR}$; resistor 66 and capacitor 68 form a smoothing circuit for signal $D_{CS}$. In one embodiment the two smoothing circuits each has a time constant of about 20 milliseconds.

After being smoothed by the smoothing circuit, $D_{LR}$ is applied to two half-wave rectifiers 82, 84 with opposite polarities. Thus, if $L_T$ has a larger amplitude than $R_T$, the signal $D_{LR}$ is blocked by rectifier 84 but is passed by rectifier 82. The signal passed by rectifier 82 is further inverted by invertor 89 to give the signal $E_L$. Conversely if $R_T$ has a larger amplitude than $L_T$, the signal $D_{LR}$ is passed by rectifier 84 but blocked by rectifier 82. In such manner rectifiers 82 and 84 provide two directional control signals $E_L$ and $E_R$ which is the inverted value of the dominance signal $D_{LR}$ when it is positive and its value when it is negative respectively. By inverting the output of rectifier 82 when the value of $D_{LR}$ is positive, both control signals $E_L$, $E_R$ are negative signals. In a similar manner half-wave rectifiers 86, 88 of opposite polarities and invertor 89 connected to rectifier 86 provide negative directional control signals $E_C$ and $E_S$ from the dominance signal $D_{CS}$ after it is smoothed, where $E_S$ is the value of $D_{CS}$ when it is negative and $E_C$ the inverted value of $D_{CS}$ when it is positive.

To recapitulate, the dominance signals $D_{LR}$ and $D_{CS}$ and the directional control signals $E_L$, $E_C$, $E_R$ and $E_S$ are as follows:

$$D_{LR} = \log_a \frac{|L_T| + k|R_T|}{|R_T| + k|L_T|}$$

$$D_{CS} = \log_a \frac{|P + k|M|}{|M| + k|P|}$$

where $P = L_T + R_T$, $M = L_T - R_T$.

and k is a constant much smaller than 1, where a is a constant.

$$E_L = \begin{Bmatrix} -D_{LR}; & D_{LR} \geqq 0 \\ 0; & D_{LR} < 0 \end{Bmatrix}$$

$$E_R = \begin{Bmatrix} 0; & D_{LR} \geqq 0 \\ D_{LR}; & D_{LR} < 0 \end{Bmatrix}$$

$$E_C = \begin{Bmatrix} -D_{CS}; & D_{CS} \geqq 0 \\ 0; & D_{CS} < 0 \end{Bmatrix}$$

$$E_S = \begin{Bmatrix} 0; & D_{CS} \geqq 0 \\ D_{CS}; & D_{CS} < 0 \end{Bmatrix}$$

The algorithm for deriving the four outputs L', R', C' and S' from the directional control signals $E_L$, $E_C$, $E_R$, $E_S$ and the two channel signals will now be described. Each of the two signals $R_T$ and $L_T$ is multiplied by a first constant raised to the power equal to a second constant b times one of the control signals $E_L$, $E_R$, $E_C$ or $E_S$. The first constant may be conveniently chosen to be a, the base of the logarithmic converters 22, 24, it being understood that other constants may be chosen instead. The exponential terms (scaler) in the multiplications may be defined as follows:

$F_L = a_L^{bE}$;
$F_R = a_R^{bE}$;
$F_C = a_C^{bE}$;
$F_S = a_S^{bE}$.

The control signals $E_L$, $E_R$, $E_C$, $E_S$ may be referred to collectively as the E signals and the exponential terms $F_L$, $F_R$, $F_C$, $F_S$ the F terms.

A vector V is defined by a 1 by 5 matrix [1 $F_L$ $F_C$ $F_R$ $F_S$]. Then the output L' is given by the equation:

$$V \times G_L \times \begin{bmatrix} L_T \\ R_T \end{bmatrix} = L' \tag{1}$$

where $G_L$ is a 5 by 2 matrix. Similarly, the output C', R' and S' are determined by the following equations:

$$V \times G_R \times \begin{bmatrix} L_T \\ R_T \end{bmatrix} = R' \tag{2}$$

$$V \times G_C \times \begin{bmatrix} L_T \\ R_T \end{bmatrix} = C' \tag{3}$$

-continued $$V \times G_S \times \begin{bmatrix} L_T \\ R_T \end{bmatrix} = S' \quad (4)$$

The matrices $G_L$, $G_R$, $G_C$, $G_S$ are referred to below collectively as the G matrices.

Figure 8:
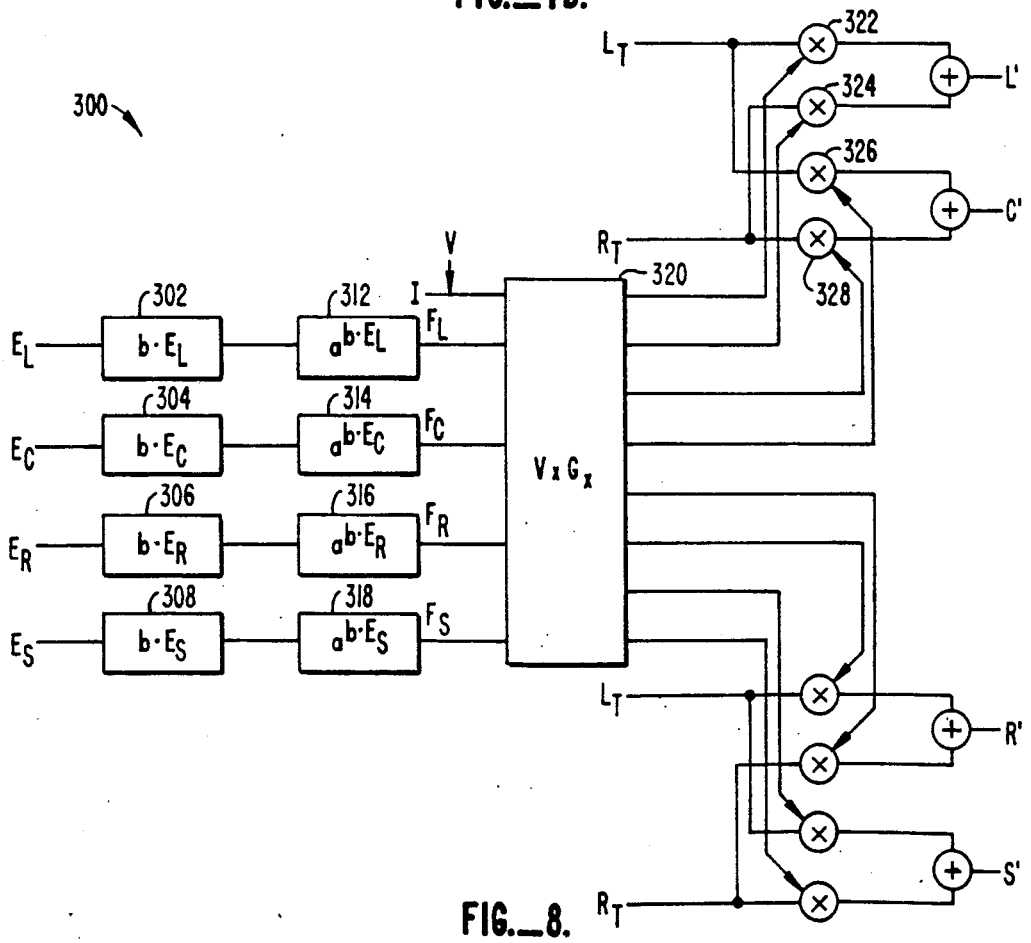
FIG. 8 is a block diagram of a matrix circuit suitable for use in a variable matrix decoder to illustrate an alternative embodiment of a four output channel decoder.

FIG. 8 is a block diagram of a matrix circuit 300 for a decoder illustrating an alternative embodiment of the invention which is a direct implementation of the matrix equations above. While the matrix circuit 300 of FIG. 8 illustrates more clearly the operation of the invention in the form of the above matrix equations, it is not as advantageous as matrix circuit 100 of FIG. 1 for reasons to be described below. As shown in FIG. 8 and in reference to FIG. 1, the 4 directional control signals $E_L$, $E_C$, $E_R$, $E_S$ from the rectifiers 82–88 are applied respectively to amplifier circuits 302, 304, 306, 308, where they are each amplified by a constant b and then applied to four exponentiation circuits 312, 314, 316, 318 where they are exponentiated to base a which may conveniently be the same base as logarithmic converters 22, 24. Thus the exponentiation circuits 312–318 supply outputs $F_L$, $F_C$, $F_R$, $F_S$ to a matrix multiplier circuit 320 which performs the V×G parts of the four matrix multiplications of equations (1)–(4). Circuit 320 supplies output signals determining the proportions of the channel signals to be applied to the 4 outputs. These signals are applied to eight four-quadrant multipliers where they are multiplied by $L_T$, $R_T$ to give the 4 outputs L', C', R', S'.

From the above description, it will be evident that circuit 300 follows closely the matrix equations (1)–(4) for the four outputs. Compared to the matrix circuit 100 of FIG. 1 described below, however, circuit 300 is not as advantageous since it includes four-quadrant multipliers, which are complex and expensive. The multipliers 71–78 of FIG. 1 need only be two-quadrant multipliers.

The results of matrix multiplications in the above decoding equations (1)–(4) are also obtained by the decoder system 10 of FIG. 1. Instead of having to use four separate exponentiators 312–318 and eight multipliers, it is now possible to combine the two functions. By using multipliers, or voltage controlled amplifiers, whose gain is proportional to the exponent of an applied control voltage, this exponentiation is performed in the same element that performs the multiplication. One such exponentially responsive voltage controlled amplifier is Phillips number TDA1074A.

In reference to FIG. 1, the matrix circuit 100 includes eight multiplier circuits, 71–78, each having two inputs. Channel signal $L_T$ is applied to multipliers 71–74, and the channel signal $R_T$ to the inputs of multipliers 75–78. The directional control signals $E_C$, $E_S$ are then applied to the remaining inputs of multipliers 74, 78 and 72, 76, respectively. The directional control signals $E_L$, $E_R$ are also supplied to the remaining inputs of multipliers 71, 75 and 73, 77 respectively. Multipliers 71, 72, 73, 74 multiply $L_T$ by signals ($F_L$, $F_R$, $F_C$, $F_S$) which are exponential functions of the directional control signals $E_L$, $E_R$, $E_C$, $E_S$ in the manner described above to provide four product signals to output matrix circuit 90. Multipliers 75, 76, 77, 78 multiply $R_T$ by signals ($F_L$, $F_R$, $F_C$, $F_S$) which are exponential functions of the four directional control signals $E_L$, $E_R$, $E_C$, $E_S$ in the manner described above to provide four additional product signals to output matrix circuit 90. The two channel signals $L_T$ and $R_T$ are also applied to circuit 90. Matrix circuit 90 then provides a weighted sum of the ten signals to provide four outputs L', C', R', S' which are then the output signals of decoder 10. These four outputs are the same as those of decoder 300 of FIG. 8.

In the above matrix equations (1)–(4), the matrix V provides directional information derived from the two channel signals $L_T$, $R_T$ in the manner described above. The four matrices $G_L$, $G_R$, $G_C$, $G_S$ define how this information is used to enhance the directional properties of the output signals. Since some of the directional information has been lost during the encoding process, the directional information contained in $L_T$, $R_T$, and in the matrix V is inadequate to completely define the directional properties of the outputs L', R', C', S'. Thus given the same directional information provided by matrix V, the four outputs can take on a range of values. The G matrices restrict each output to only one value corresponding to a given value for each of the components of the matrix V; the G matrices further define and steer the directional sound effects of the four outputs.

From the above, it will be evident that further conditions must be set to completely define the values of the four outputs given certain directional information provided by matrix V. These conditions may be set by specifying the proportions of $L_T$ and $R_T$ present at each of the four outputs at particular values of $L_T$, $R_T$, P or $L_T+R_T$, and M or $L_T-R_T$. These conditions will determine the coefficients of the G matrices so that the above four matrix equations employing such G matrices will provide the desired proportions of $L_T$, $R_T$ at the outputs at the particular values of $L_T$, $R_T$, P, M. In the preferred embodiment, these conditions are set by means of the following matrix equations:

$$Q \times G_L = H_L; \quad (5)$$

$$Q \times G_R = R_R; \quad (6)$$

$$Q \times G_C = H_C; \quad (7)$$

$$Q \times G_S = H_S; \quad (8)$$

where Q is a 5×5 matrix and $H_L$, $H_R$, $H_C$, $H_S$ are 5×2 matrices. Matrices $H_L$, $H_R$, $H_C$, $H_S$ are collectively referred to below as the H matrices.

The following are a set of H matrices which give the proportions of $L_T$ and $R_T$ in the four output channels corresponding to five sets of values for $L_T$, $R_T$, P, M:

$$H_L \quad \begin{bmatrix} \frac{1}{\sqrt{2}} & 0 \\ 1 & 0 \\ \frac{1}{\sqrt{6}} & \frac{-1}{\sqrt{6}} \\ \frac{1}{\sqrt{3}} & 0 \\ \frac{1}{\sqrt{6}} & \frac{1}{\sqrt{6}} \end{bmatrix}$$

-continued $$H_C \quad \begin{bmatrix} \frac{1}{2} & \frac{1}{2} \\ 0 & \frac{1}{\sqrt{3}} \\ \frac{1}{\sqrt{2}} & \frac{1}{\sqrt{2}} \\ \frac{1}{\sqrt{3}} & 0 \\ \frac{1}{\sqrt{6}} & \frac{1}{\sqrt{6}} \end{bmatrix}$$

$$H_R \quad \begin{bmatrix} 0 & \frac{1}{\sqrt{2}} \\ 0 & \frac{1}{\sqrt{3}} \\ \frac{-1}{\sqrt{6}} & \frac{1}{\sqrt{6}} \\ 0 & 1 \\ \frac{1}{\sqrt{6}} & \frac{1}{\sqrt{6}} \end{bmatrix}$$

$$H_S \quad \begin{bmatrix} \frac{1}{2} & \frac{-1}{2} \\ 0 & \frac{-1}{\sqrt{3}} \\ \frac{1}{\sqrt{6}} & \frac{-1}{\sqrt{6}} \\ \frac{1}{\sqrt{3}} & 0 \\ \frac{1}{\sqrt{2}} & \frac{-1}{\sqrt{2}} \end{bmatrix}$$

The five sets of values for $L_T$, $R_T$, P, M are as follows:

1. The magnitudes of $L_T$ and $R_T$ are equal and so are those of P, M. Hence $F_L=F_R=F_C=F_S=1$. The V matrix is [1 1 1 1 1]. This is known as the unsteered condition since V contains no directional steering information.

2. $L_T$ is non-zero and $R_T$ is zero, and P, M have equal amplitudes. The may be called steering to the left. The V matrix is [1 0 1 1 1].

3. P is non-zero and M is zero. $L_T$, $R_T$ have equal amplitudes. The matrix V is [1 1 0 1 1].

4. . $R_T$ is non-zero and $L_T$ is zero and P and M have equal amplitudes. This may be called steering to the right. The V matrix is [1 1 1 0 1].

5. M is non-zero but P is zero. $L_T$ and $R_T$ have equal amplitudes. The matrix V is [1 1 1 1 0].

The Q matrix is formed by arranging the above five V matrices placed one on top of the other, or as follows:

$$Q = \begin{bmatrix} 1 & 1 & 1 & 1 & 1 \\ 1 & 0 & 1 & 1 & 1 \\ 1 & 1 & 0 & 1 & 1 \\ 1 & 1 & 1 & 0 & 1 \\ 1 & 1 & 1 & 1 & 0 \end{bmatrix}$$

Then, $G_L$ may be obtained from the equation $Q \times G_L = H_L$, where the coefficients of $H_L$ take on the values listed above. Thus the first row of $H_L$ are the proportions of $L_T$ and $R_T$ present in the L' output during the unsteered condition, or $L'=1/2L_T+OR_T$, giving $L'=L_T/2$. The second row of $H_L$ are the proportions of $L_T$, $R_T$ in the L' output during condition 2 above, so that $L'=1L_T+OR_T=L_T$. The third to fifth rows of $H_L$ are the proportions of $L_T$, $R_T$ present in the L' output during conditions 3, 4, 5 listed above respectively. The other three matrices $H_C$, $H_R$, $H_S$ give the proportions of $L_T$, $R_T$ present in the C', R', S' outputs during the five conditions above in substantially the same manner as $H_T$ just described.

Solving for G using the above values for Q and H, the coefficients of G may be obtained and are set forth below:

$$G_L = \begin{bmatrix} 0.273 & 0 \\ -0.293 & 0 \\ 0.299 & 0.408 \\ 0.130 & 0 \\ 0.299 & -0.408 \end{bmatrix} \quad G_C = \begin{bmatrix} 0.193 & 0.193 \\ 0.5 & -0.077 \\ -0.207 & -0.207 \\ -0.077 & 0.5 \\ 0.092 & 0.092 \end{bmatrix}$$

$$G_R = \begin{bmatrix} 0 & 0.273 \\ 0 & 0.130 \\ 0.408 & 0.299 \\ 0 & -0.293 \\ -0.408 & 0.299 \end{bmatrix} \quad G_S = \begin{bmatrix} 0.193 & -0.193 \\ 0.5 & 0.077 \\ 0.092 & -0.092 \\ -0.077 & -0.5 \\ -0.207 & 0.207 \end{bmatrix}$$

With the above set of G matrices, the matrix equations (1)–(4) will enhance the directional properties of the four output signals in accordance with the directional information provided by $L_T$, $R_T$. From the above, it will be noted that there are two constants a and b in the matrix equations (1)–(4) . The constant a, however, will disappear from the equations since the exponentiation by the eight multipliers will cancel the logarithmic conversion of converters 22, 24. The constant b depends on the gains in the various stages of the control circuit in the decoder. For the above set of values of $G_X$, the directional properties of the outputs may be optimized when b is approximately 0.839. Obviously, the optimum value of b will change with the values for the H matrices.

An alternative set of H matrices, ay be used instead and are as follows:

$$H_L = \begin{bmatrix} \frac{\sqrt{2}}{\sqrt{3}} & 0 \\ 1 & 0 \\ \frac{1}{2\sqrt{2}} & \frac{-1}{2\sqrt{2}} \\ \frac{\sqrt{2}}{\sqrt{3}} & 0 \\ \frac{1}{\sqrt{6}} & \frac{1}{\sqrt{6}} \end{bmatrix}$$

-continued $$H_C = \begin{bmatrix} \frac{1}{2\sqrt{3}} & \frac{1}{2\sqrt{3}} \\ 0 & \frac{1}{\sqrt{6}} \\ \frac{1}{\sqrt{2}} & \frac{1}{\sqrt{2}} \\ \frac{1}{\sqrt{6}} & 0 \\ \frac{1}{\sqrt{6}} & \frac{1}{\sqrt{6}} \end{bmatrix}$$

$$H_R = \begin{bmatrix} 0 & \frac{\sqrt{2}}{\sqrt{3}} \\ 0 & \frac{\sqrt{2}}{\sqrt{3}} \\ \frac{-1}{2\sqrt{2}} & \frac{1}{2\sqrt{2}} \\ 0 & 1 \\ \frac{1}{\sqrt{6}} & \frac{1}{\sqrt{6}} \end{bmatrix}$$

$$H_S = \begin{bmatrix} \frac{1}{2} & \frac{-1}{2} \\ 0 & \frac{-1}{\sqrt{6}} \\ \frac{1}{2} & \frac{-1}{2} \\ \frac{1}{\sqrt{6}} & 0 \\ \frac{1}{\sqrt{2}} & \frac{-1}{\sqrt{2}} \end{bmatrix}$$

If the above set of H matrices is used to decode the two channel signals, the constant b preferably is about 1.303.

Figure 2A:
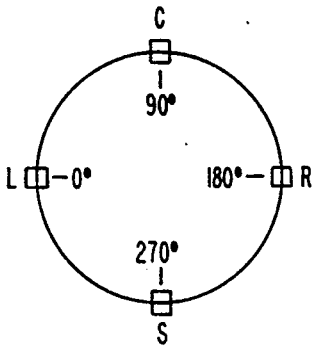
FIG. 2A is a schematic view of the hypothetical positions of 4 speakers to illustrate the graphs in FIGS. 2B, 3 and 4.
Figure 2B:
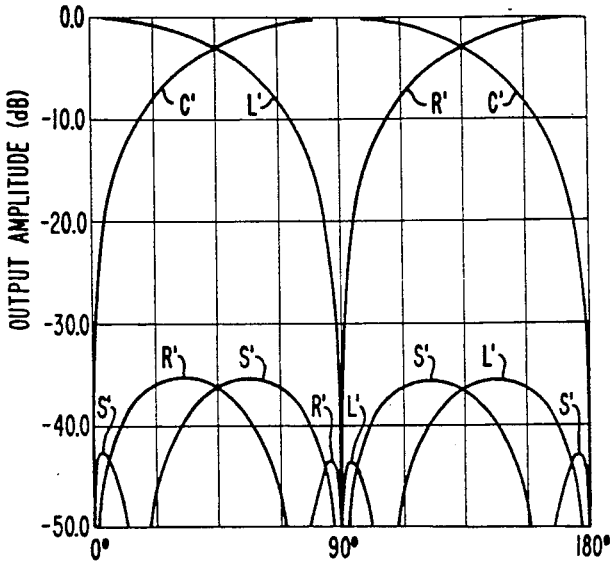
FIG. 2B is a graph showing four channel outputs as functions of the directional information in the two channel input signals.
Figure 3:
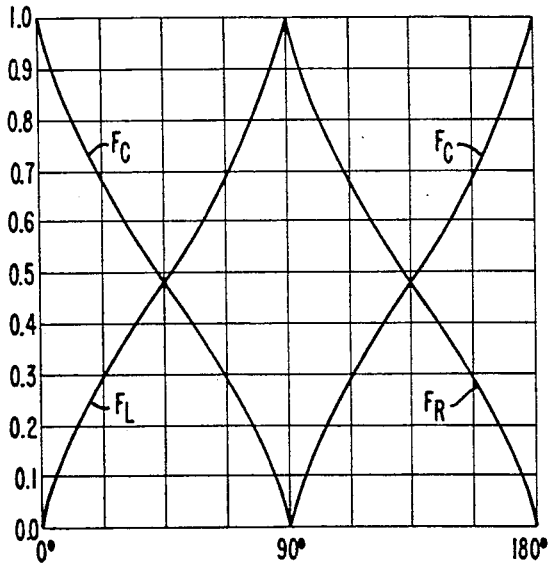
FIG. 3 is a graph showing the variation of the control voltages as functions of the directional information of the channel signals.
Figure 4:
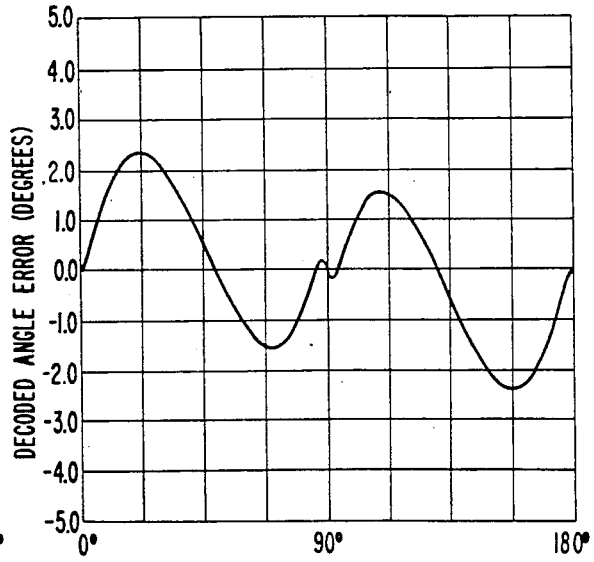
FIG. 4 is a graph showing the error angle between the perceived angle and direction of the channel outputs versus the encoded directions of the information.

Panning angles are used to represent apparent sound locations within a hypothetical listening area bounded by a circle with the four hypothetical loudspeaker positions as shown in FIG. 2A. The left loudspeaker is assigned the position 0 degrees, the center 90, the right 180, and the surround 270. Thus a sound source panned from 0 to 180 degrees would appear to start at the left loudspeaker, progress clockwise around the circle towards the center, and continue to the right. When a sound source is panned from left to center, for example, it is desirable that the outputs from the right and surround loudspeakers remain at very low levels so as not to interfere with the sound localization. The above set of values for b and G results in very low crosstalk levels. This can be seen, for example, from FIG. 2B, which shows that crosstalk from speakers not involved in a pan has a maximum amplitude of about −35 dB. FIG. 3 shows values of control signals $F_L$, $F_C$, and $F_R$ at panning angles from 0 to 180 degrees. FIG. 4 shows that the decoded angle error, which is the angular error between the encoded angle of the sound versus the perceived angle of the decoded sound, is only about 2.5 degrees out of a range of 180 degrees.

The functions of the two averaging circuits comprising resistor 42, capacitor 44 and resistor 46, capacitor 48 and the two switches 52, 54 will now be described. The two signals $D_{LR}$, $D_{CS}$ indicating dominance information are supplied to threshold detection circuit 56. If the two dominance signals are detected to be both below a certain set threshold, this means that no dominance signals have been detected, indicating no directional information is available from the two channel signals. In such circumstances it may be desirable to maintain the direction steering applied during a previous time period. Thus, when circuit 56 detects the condition that all dominance signals are below the threshold, it causes switches 52 and 54 to switch from position 94 to position 96 to include the two delay circuits. The outputs L', C', R' and S' are therefore maintained at their present level for a time period determined by the time constants of the two averaging circuits.

FIGS. 5A and 5B are two alternative circuits for each of the differential logarithmic converters 22, 24. As shown in FIG. 5A, the two input signals (either $L_T$, $R_T$ or P and M) are rectified by full-wave rectifiers 102, 104. Small fractions k of the rectified signals are added as crosstalk signals by means of attenuators 130 and summers 132, and the resulting signals are then supplied to two logarithmic circuits 106, 108 whose outputs are applied to a summer 110 which provides the difference between the outputs of circuits 106 and 108. FIG. 5B is a schematic circuit diagram of a differential logarithmic converter to illustrate the preferred embodiment of converters 22, 24. The pair of signals ($L_T$, $R_T$ or P, M) are rectified by rectifiers 102, 104. Small fractions k of the rectified signals are then added and the summed signals applied to the emitters of two bipolar transistors 112 and 114, respectively. The emitters of transistors 112 and 114 are also connected to the positive and negative inputs respectively of an operational amplifier. 116, whose output is connected to the base of transistor 114 through a resistor 122 with resistor 124 from the base of transistor 114 to a fixed reference voltage, forming an attenuator. The base of transistor 112 is connected to substantially the same fixed reference voltage.

Operational amplifier 116 will attempt to keep the emitters of transistors 112 and 114 at the same voltage. For simplicity, the crosstalk fractions introduced will be omitted in the discussion below in reference to FIG. 5B. Since transistors 112 and 114 are chosen to be identical, when the magnitudes of $L_T$ and $R_T$ are equal, the output voltage at node 120 is substantially equal to the reference voltage. If the magnitudes of $L_T$ and $R_T$ are such that the current drawn through transistor 112 and rectifier 102 increases, the voltage at the emitter of transistor 112 will become more negative. Operational amplifier 116 will cause the emitter of transistor 114 to match that of transistor 112 by decreasing the voltage at the base of transistor 114. The output voltage of the converter at node 120 therefore decreases with respect to the reference voltage at the base of transistor 112, 114. On the other hand, if the magnitude of $R_T$ increases relative to that of $L_T$ so that the current drawn through transistor 114 increases, this causes the voltage difference between the base and emitter of transistor 114 to increase. The voltage at the emitter of transistor 112 remains unchanged. Operational amplifier 116 causes the emitter of transistor 114 to match that of transistor 112 so that the voltage at the emitter of transistor 114 also remains unchanged. Therefore, when the collector current through transistor 114 increases, the output voltage at node 120 increases in order to cause the voltage at the base of transistor 114 to rise. The output voltage at 120 varies as the logarithm of the collector-emitter current through transistor 114. Therefore, the output voltage at node 120 is proportional to the logarithm of the ratio of the amplitudes of $L_T$ and $R_T$.

Figure 6:
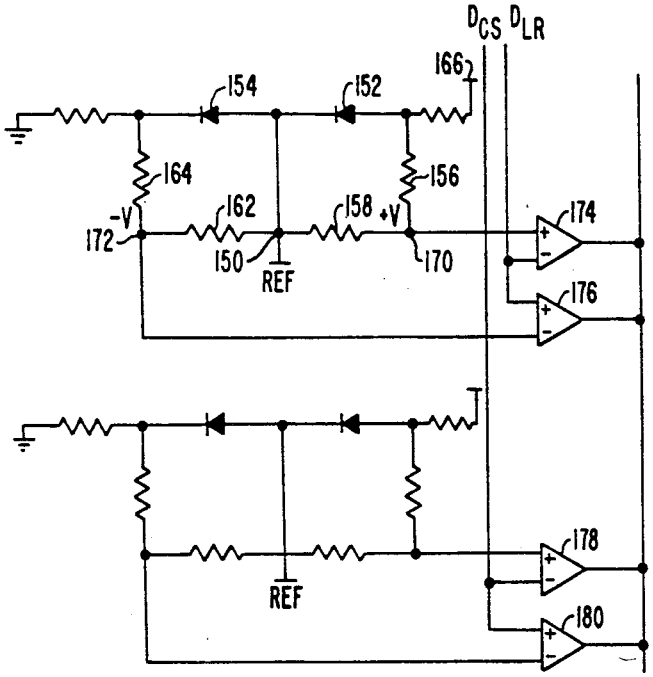
FIG. 6 is a schematic circuit diagram of a threshold detection circuit for the decoder of FIG. 1 to illustrate a four output channel decoder.

FIG. 6 is a schematic circuit diagram of the threshold detection circuit 56 of FIG. 1. As shown in FIG. 6, node 150 is maintained at a reference voltage equal to that of FIG. 5B by an external source (not shown). In the discussion below in reference to FIG. 6, voltages greater than that at node 150 are defined as positive voltages and those less than it negative voltages. By means of diodes 152, 154 and resistors 156, 158, 162, 164 and DC voltage supply 166, node 170 is maintained at a fixed small positive voltage above the reference voltage at 150, and node 172 is maintained at a fixed small negative voltage below that of reference voltage at node 150. The voltages at nodes 170, 172 set the threshold voltages for circuit 56. The signal $D_{LR}$ is applied to the negative and positive inputs respectively of comparators 174, 176. The positive input of comparator 174 is connected to node 170, and the negative input of comparator 176 is connected to node 172. Therefore, if the signal $D_{LR}$ is positive and greater than that at node 170, comparator 174 causes its output to be pulled low. Similarly, if the signal $D_{LR}$ is negative and less than that at node 172, comparator 176 also causes its output to be pulled low. The outputs of the comparators 174 and 176 are connected together. Another similar circuit may be used to detect whether the signal $D_{CS}$ is below certain fixed thresholds. When signal $D_{CS}$ is above the thresholds set in such circuit, the outputs of comparator 178, 180 are pulled low. The four comparator 174, 176, 178 and 180 are all connected at the outputs so that if the dominance signals $D_{LR}$, $D_{CS}$ exceed any one of the thresholds set, indicating the presence of dominance information, this causes one of the comparator outputs to be pulled low, so that switches 52, 54 are in position 94. Thus, whenever dominance information is present, both delay circuits are switched out of the signal path. When no dominance information is present so that the dominance signals are within the thresholds set by the circuit of FIG. 6, none of the outputs of the comparators 174, 176, 178, 180 is pulled low. Thus a high signal is sent to switches 52, 54 causing them to switch to position 96, thereby switching in the two delay circuits to hold the previously existing directional pattern.

Figure 7A:
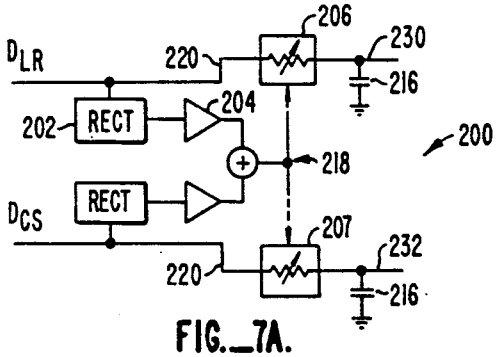
FIG. 7A is a schematic circuit diagram for a variable circuit suitable for use in the decoder of FIG. 1 to illustrate a four output channel decoder.
Figure 7B:
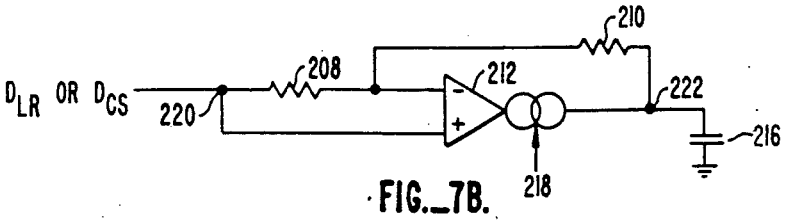
FIG. 7B is a schematic circuit diagram of a specific implementation of the circuit of FIG. 7A.

Instead of using an on-off approach to averaging as described above, an averaging circuit with a variable time constant varying with the degree of dominance information may be used. FIGS. 7A, 7B illustrate this approach. As shown in FIG. 7A, dominance signal $D_{LR}$ is rectified by rectifier 202 and amplified by amplifier 204. The rectified and amplified signal is added to a similar signal derived from $D_{CS}$ and then used to change both variable resistances 206 and 207 to vary the averaging time constants introduced; the time constants should be inversely related to the sum of the magnitudes of signals $D_{LR}$ and $D_{CS}$. The components 42, 44, 46, 48, 52, 54, 56, 62, 64, 66, 68 in FIG. 1 may be replaced by the circuit of FIG. 7A, where the output 230 is applied to rectifiers 82, 84 and the output 232 to rectifiers 86, 88.

FIG. 7B is a specific implementation of the variable resistances in the averaging circuit of FIG. 7A, where identical parts are labeled by the same numerals. The variable resistances 206 and 207 can be realized as shown in FIG. 7B using an operational transconductance amplifier, such as the RCA part number CA3080. The positive input of this amplifier is connected to either $D_{LR}$ or $D_{CS}$, and the negative input is connected to the junction of two resistors, 208 and 210. Such a circuit has a maximum resistance equal to the sum of the two resistors, and a minimum resistance determined by the maximum gain of the amplifier. A proportion of the voltage difference between the positive input and the output is amplified by the amplifier 212 and presented to the load, in this case capacitor 216, as a current. Increasing the amplifier's transconductance increases the amount of current applied to the load for a given voltage differential between nodes 220 and 222, reducing the effective resistance driving the load.

Figure 7C:
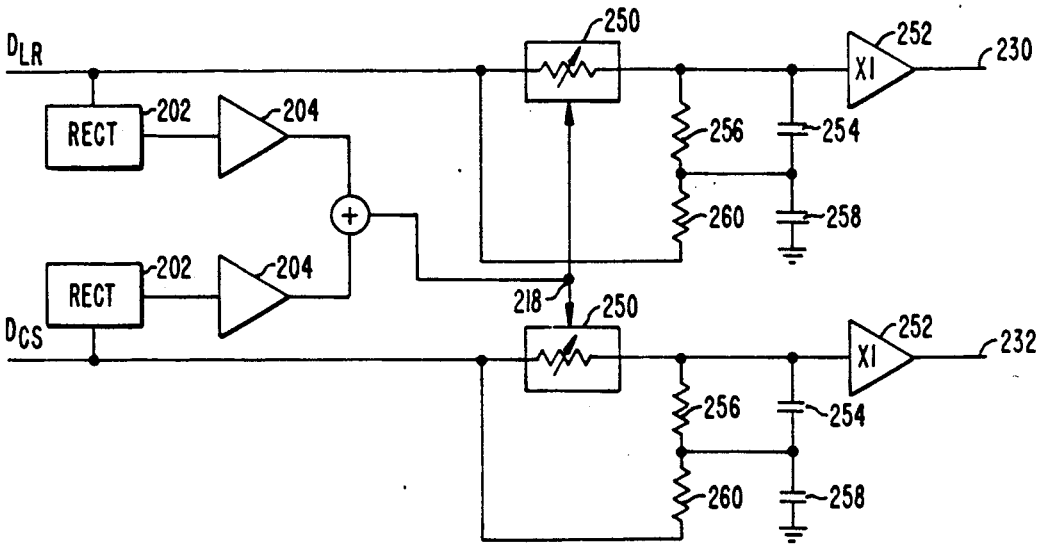
FIG. 7C is a schematic circuit diagram for a variable circuit suitable for use in the decoder of FIG. 1 to illustrate a four output channel decoder.

FIG. 7C illustrates the preferred embodiment for varying the averaging time with the magnitude of dominance signals. When the components 42–68 enumerated above are replaced by the circuit of FIG. 7C, FIG. 1 is then the preferred embodiment of the variable matrix decoder of this application. The averaging circuit of FIG. 7C is somewhat similar to that in FIG. 7A so that identical parts are referred to by the same numerals in both figures. As in FIG. 7A, the two dominance signals are rectified and amplified and then added to form a control signal at node 218 for controlling the resistance of two variable resistors 250. Instead of being connected to a simple capacitor as in FIG. 7A, the variable resistors in FIG. 7C are each connected to two capacitors 254, 258 and to two resistors 256, 260. Resistor 260 is also connected to input $D_{LR}$ or $D_{CS}$. Since the two paths for averaging the two dominance signals are identical, discussion of only one, that for $D_{LR}$, is adequate.

When there is directional information present in the channel signals, the control signal at node 218 will have significant amplitude. This reduces the resistance of variable resistors 250 and causes capacitor 254 to be charged. Capacitor 254 has a relatively small capacitance so that its voltage responds quickly to the dominance signal; such voltage is passed by buffer 252 to be rectified by rectifiers 82, 84 and then to the matrix circuit 100 as described above in reference to FIG. 1. While capacitor 254 is being charged, capacitor 258 is also being charged through a first path comprising resistors 250, 256 and a second path through resistor 260. Capacitor 258, however, has a large capacitance so that the voltage thereon indicates an average value of the dominance signal. When there is little or no dominance information present in the channels, the control signal at node 218 drops to zero or near zero. This causes the resistances of variable resistors 250 to increase to a large value so that they essentially represent open circuits. Capacitor 254 discharges quickly through resistor 256 so that the outputs 230, 232 are the voltages across capacitors 258 in both branches of the circuit in FIG. 7C.

When there is little or no dominance information the dominance signal $D_{LR}$ is essentially zero or near zero. Hence, capacitor 258 will discharge through resistors 260 so that if the channels contain no directional information for a long enough time, capacitors 258 will be completely discharged, causing decoder 10 to return to an essentially unsteered condition.

Figure 7D:
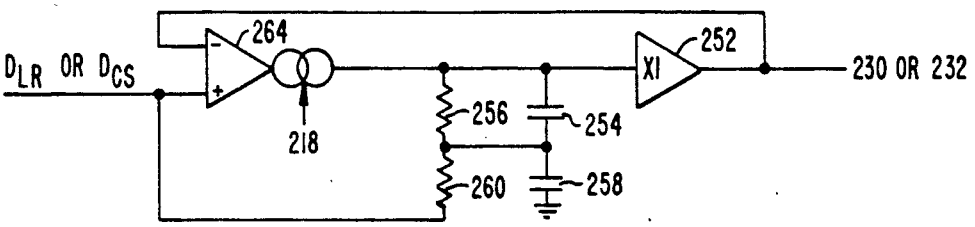
FIG. 7D is a schematic circuit diagram of a specific implementation of the circuit of FIG. 7C.

FIG. 7D is an implementation to variable resistors 250 using a transconductance amplifier 264. Identical components in FIGS. 7C, 7D are labeled with the same numerals. The output of buffer 252 is fed back to the inverting input of the transconductance amplifier so that the amplifier becomes a variable resistor whose resistance varies inversely with a control signal applied at node 218.

In the description above, only two channel signals are recorded and decoded. It will be understood that if more than two channel signals are recorded, the invention will function in the same manner to enhance directionality. Where more than two channel signals are recorded, the signals may be grouped in pairs and each pair treated in the same manner as $L_T$, $R_T$ described above.

In the above discussion the four outputs L', R', C', and S' are applied to loudspeakers placed for motion picture theater applications as described in the background. This invention may also be used in the home for providing four-channel playback of suitably encoded recordings, including motion pictures on video cassettes or video disks or other consumer media. By choosing an appropriate set of G matrices, it is also possible to configure the decoder to provide signals to drive loudspeakers placed at the corners of a room. All such configurations are within the scope of this invention.

Figure 9:
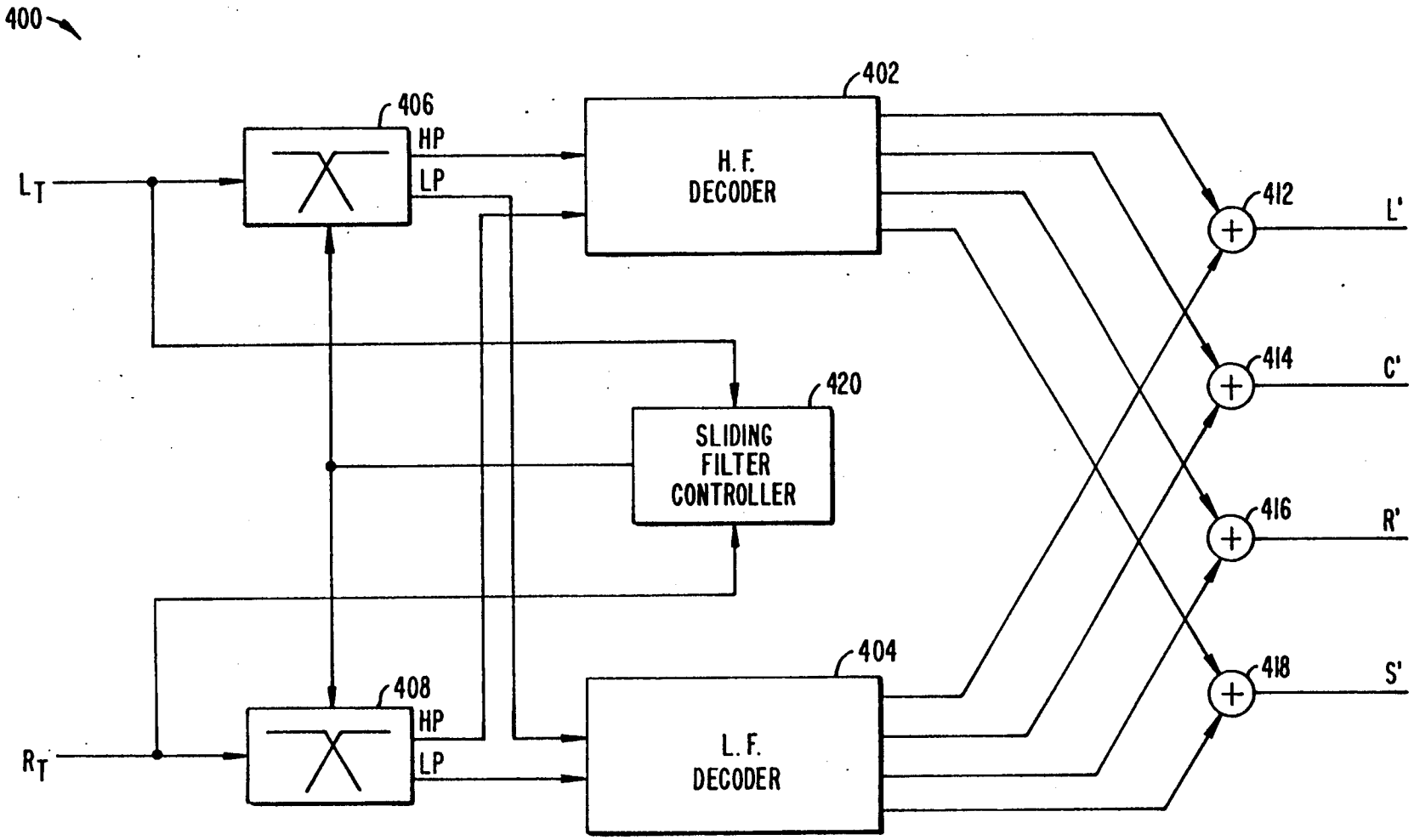
FIG. 9 is a block diagram of a split band variable matrix decoder to illustrate another aspect of a four output channel decoder.

FIG. 9 is a block diagram of a split band variable matrix decoder system illustrating the invention. As shown in FIG. 9 system 400 comprises two decoders 402, 404 each of which may be constructed as described above in reference to FIG. 1 but as modified by FIG. 7C as described above. The two channel signals $L_T$, $R_T$ are each passed through crossover filters 406 and 408. The two crossover filters preferably have the same crossover frequency. The frequency components of $L_T$, $R_T$ above the crossover frequency are fed to decoder 402 for deriving the high frequency components of the outputs L', C', R', S'. The low frequency components of $L_T$, $R_T$, that is components having frequencies below the crossover frequency, are fed to decoder 404 for deriving the low frequency components of the output. Summer 412 then adds the high and low frequency components of L' to give the output L'. Similarly, summers 414–418 each adds the corresponding high and low frequency components to give outputs C', R', S'.

In applications such as in motion picture theaters, it may be desirable to enhance only the directionality of only the speech signals from actors, not music or other background sound. Speech signals are typically in the lower frequency range and are generally destined for the center loudspeaker. Thus, it may be desirable to choose the crossover frequency of the two filters so that the signals destined for the center loudspeaker are decoded only by decoder 404 and not by decoder 402. Thus, the speech signals and background signals in the frequency range of the speech signals are processed entirely by decoder 404 to enhance the directional effects of the speech signals, without at the same time erroneously steering the high frequency background signals. This creates a more realistic impression of the original program in which the speech signals are originally from the front stage whereas background sounds originate from many directions.

The crossover frequency or frequencies of the two filters, 406, 408 may be changed depending on the dominance conditions in $L_T$, $R_T$. One desirable result of system 400 is that the common crossover frequency of the two filters is at the top end of the frequency band of signals destined for the center loudspeaker. Thus, the two channel signals are fed to a detector 420 for detecting the frequency band of signals destined for the center loudspeaker. Detector 420 then provides a control signal applied to the two filters for sliding the crossover frequency in such manner that the crossover frequency coincides substantially with the top end of the frequency band of signals destined for the center loudspeaker at all times.

One particular implementation of the circuit of FIG. 9 is based on the realization that if the crossover frequency of the two filters is moved so that the dominance signal $D_{CS}$ derived in a manner described above from the low frequency portions of $L_T$, $R_T$ bears a large constant ratio (e.g. 10:1) to the dominance signal $D_{CS}$ derived from the high frequency portions of these channel signals, then, most of the signal components intended for the center loudspeaker are in the low frequency regions below the crossover frequency. In such circumstances, the crossover frequency coincides approximately with the top end of the frequency band destined for the center loudspeaker.

Figure 10:
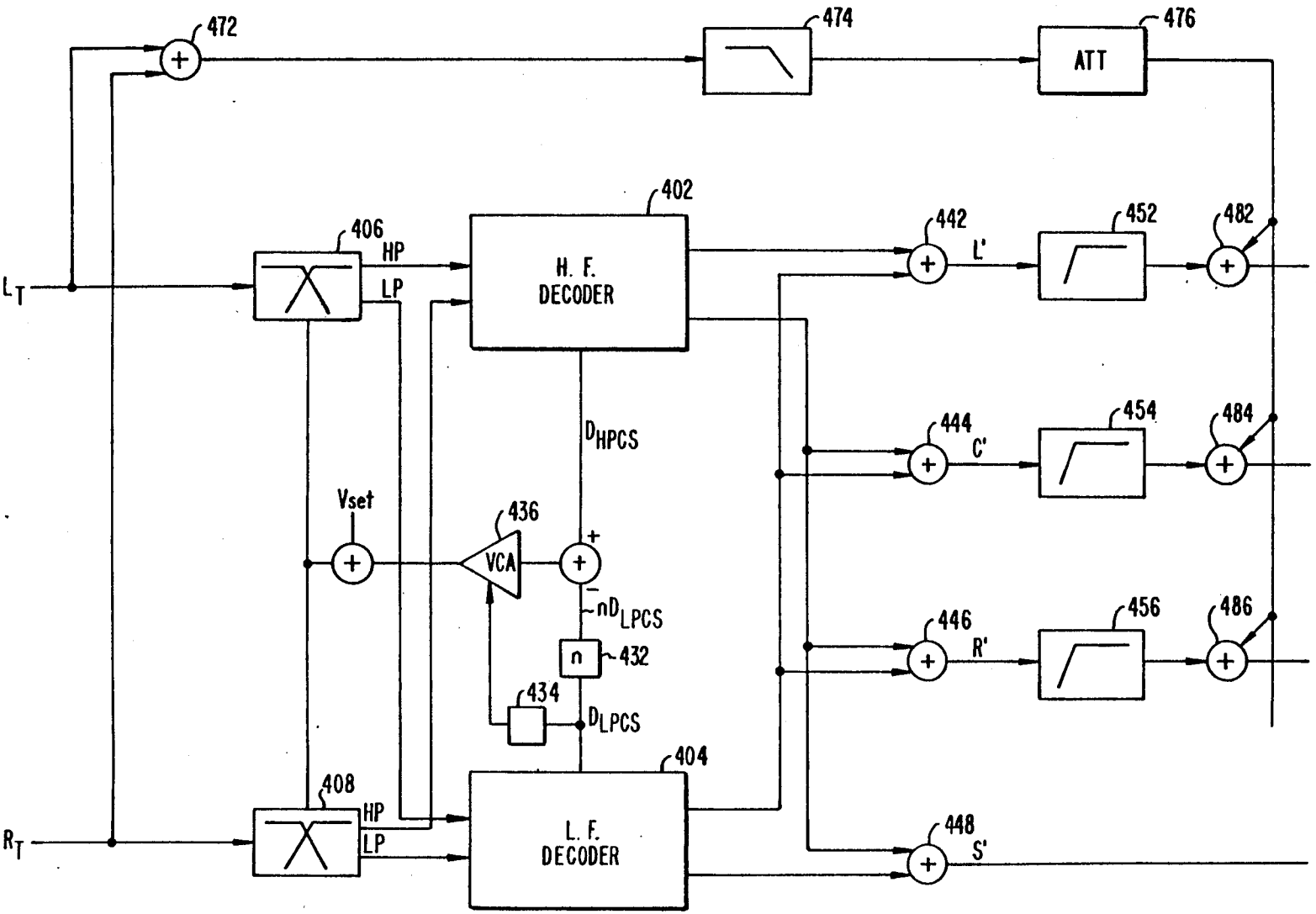
FIG. 10 is a more detailed block diagram of a split band variable matrix decoder illustrating one implementation of the decoder of FIG. 9, and illustrating yet another aspect of a four output channel decoder.

Since the signals indicating the dominance of the center or surround channels, $D_{CS}$, for both the low and high frequency portions of the channel signals are already available from decoders 402 and 404, system 400 of FIG. 9 can be simply implemented by taking advantage of the signals already available from the decoders, as implemented in FIG. 10. Thus, the dominance signal indicating the dominance, if any, of the high frequency portions of the center and surround channels, indicated as $D_{HPCS}$ is provided by decoder 402. The corresponding dominance signal for the low frequency portion, $D_{LPCS}$ is provided by decoder 404. The dominance signal DLPCS is attenuated by attenuator 432 and then subtracted from the dominance signal $D_{HPCS}$. The difference is then applied to a voltage Controlled amplifier 436. The dominance signal $D_{LPCS}$ is passed through a half-wave rectifier and filter circuit 434 so that the gain of amplifier 436 is controlled by the presence of center dominance in $D_{LPCS}$. The output of the amplifier 436 is added to a constant Voltage Vset and then applied to the two filters 406, 408 for sliding the crossover frequency.

When the frequency range of signals destined for the center channel changes, causing the values of the two dominance signals $D_{HPCS}$ and $D_{LPCS}$ to change, this changes the value of the control signal applied to the filters 406, 408. The crossover frequency of the two filters are then caused to change, which in turn changes the values of the two dominance signals to maintain a constant ratio between the two signals. A ratio of $D_{LPCS}$ to $D_{HPCS}$ of 10 to 1 may be satisfactory. When there is little or no center dominance in the low frequency range so that $D_{LPCS}$ is small, it is desirable not to cause sliding of the crossover frequency. In such event the magnitude of $D_{LPCS}$ applied to amplifier 436 is small, thereby reducing the gain of the amplifier to zero or near zero, which stops the sliding of the crossover frequency. A constant voltage Vset is applied to the two filters to set the crossover frequency at a particular value in the absence of dominance of signals for the center channel in the low frequency portion.

After being decoded by the decoders 402, 404, the high and low frequency portions of each output signal are added together by one of the four summers 442–448 to yield 4 output signals L', C', R' and S'. For reasons to be explained below it is preferable to distribute evenly very low frequency signal components among some of the channels. For this reason the outputs L', C' and R' are filtered by filters 452–456 whose cutoff frequencies match that of the low pass filter 474 described below.

FIG. 10 illustrates yet another aspect of the invention. This aspect is based on the observation that for very low frequency signals, for example signals below 150 Hz, it is difficult for listeners to localize the directions of such signals even if the signals are coming from only one direction. For this reason, there is no need to enhance the directionality of very low frequency signals. Furthermore, if steering is applied, such very low frequency signals may be concentrated in one speaker, causing overloading. For these reasons it is desirable to evenly distribute the very low frequency signal components. As shown in FIG. 10 the channel signals are added by a summer 472, filtered by a low pass filter 474 having a low cut off frequency (e.g. 150 Hz). The very low frequency signal components are then attenuated by attenuator 476 and then added to the outputs L', C', R' by summers 482, 484, 486. The attenuation of attenuator 476 is such that it attenuates the very low frequency signals to one-third of its previous power level. In such manner the very low frequency signals are evenly distributed among the output channels L', C', R'. Overloading of a single loudspeaker such as that for the channel C' is avoided.

By separating the very low frequencies for decoding, it is possible to limit the frequency range of signals decoded by decoder 10 of FIG. 1, when decoder 10 is incorporated as decoders 402 or 404 in the system of FIG. 10. For this reason, the channel signals are first filtered by band pass filters 15 in FIG. 1 before application to the logarithmic converters 22, 24. This reduces the requirements for decoder 10 and improves the quality of the decoding.

The description above sets forth the functions and effects of a four output channel variable matrix decoder. Now we are prepared to return to the description of variable matrix decoders which are the subject of this invention.

Figure 11:
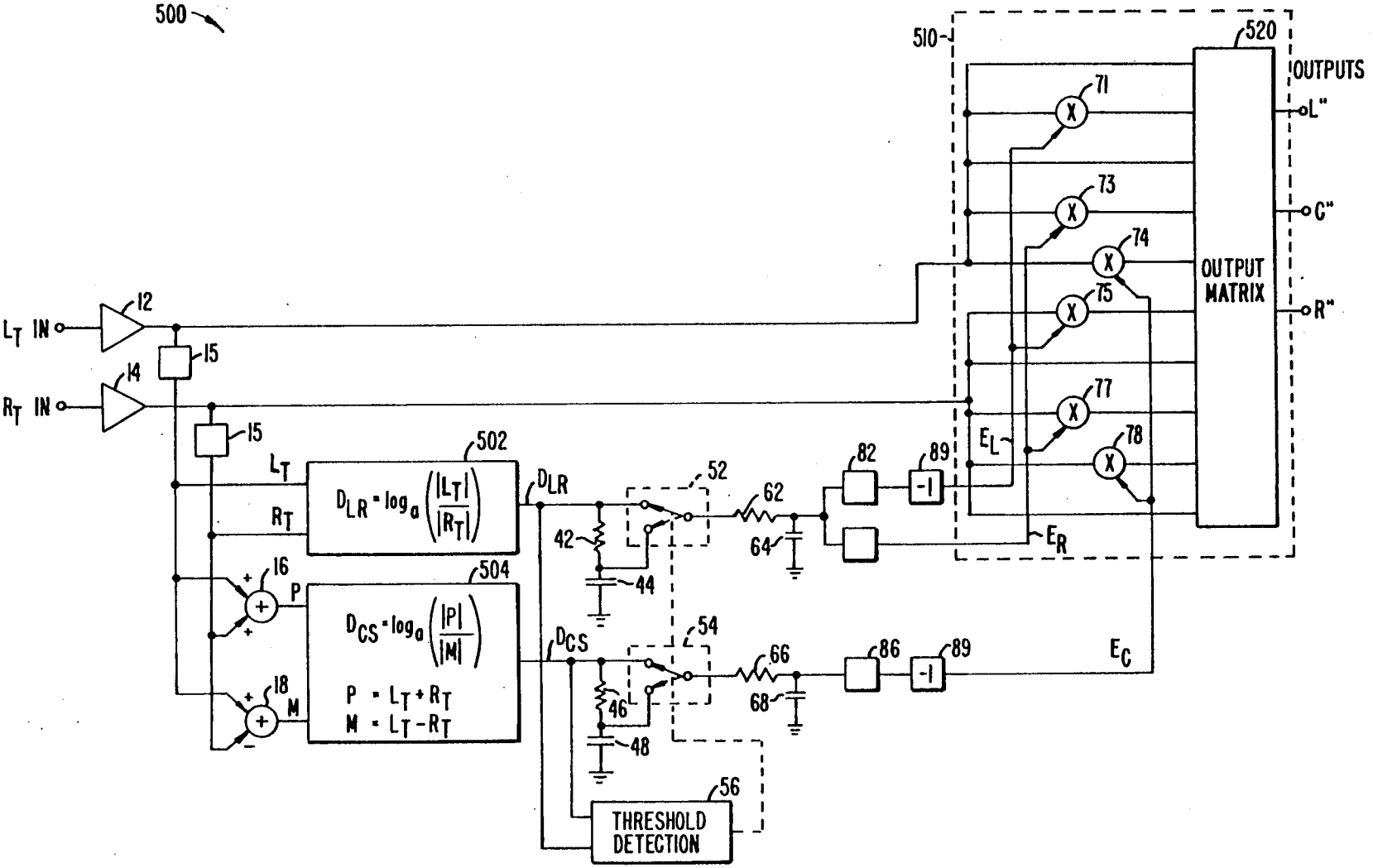
FIG. 11 is a block diagram of a decoder system with three output channels to illustrate the invention.

FIG. 11 is a block diagram of a variable matrix decoder having only three output channels to illustrate and embodiment of the invention. A comparison of FIGS. 1 and 11 will indicate that the two decoders are very similar. To simplify the description, identical components in FIGS. 1–14 are labelled by the same numerals.

The three output channel decoder 500 of FIG. 11 differs from four output channel decoder 10 of FIG. 1 in the following respects. As explained above, small cross talk signals are purposely introduced proportional to a constant k in differential logarithmic converters 22 and 24 in FIG. 1. It is found that introducing such small crosstalk signals is not necessary in many circumstances. For this reason these small crosstalk terms have been dropped from differential logarithmic converters 502, 504 in FIG. 11. Instead of providing four directional control signals $E_L$, $E_C$, $E_R$ and $E_S$ as in FIG. 1, only three directional control signals $E_L$, $E_C$ and $E_R$ are provided; these three directional control signals are defined as functions of the dominance signals $D_{LR}$ and $D_{CS}$ in exactly the same manner as described above in reference to FIG. 1. The exponential terms $F_L$, $F_R$, $F_C$ are again defined in exactly the same manner as those described in reference to claim 1. A vector V' is then defined by a 1 by 4 matrix [1 $F_L$ $F_C$ $F_R$]. Then the output L'', C'', R'' are given by the following equations:

$$V' \times G_{L'} \times \begin{bmatrix} L_T \\ R_T \end{bmatrix} = L'' \tag{9}$$

-continued $$V' \times G_{R'} \times \begin{bmatrix} L_T \\ R_T \end{bmatrix} = R'' \tag{10}$$

$$V' \times G_{C'} \times \begin{bmatrix} L_T \\ R_T \end{bmatrix} = C' \tag{11}$$

The three G' matrices are derived from the following equations (13)–(15):

$$Q' \times G_{L'} = H_{L'} \tag{12}$$

$$Q' \times G_{R'} = H_{R'} \tag{13}$$

$$Q' \times G_{C'} = H_{C'} \tag{14}$$

As before, $G_{L'}$, $G_{C'}$, $G_{R'}$ are collectively referred to as the G' matrices and $H_{L'}$, $H_{C'}$ and $H_{R'}$ are collectively referred to below as the H' matrices. In the above equations, each of the three G' matrices is a 4 by 2 matrix, Q' being a 4 by 4 matrix and the three H' matrices are each 4 by 2 matrices.

The following are a set of H' matrices which give the proportions of $L_T$ and $R_T$ in the three upper channels corresponding to four sets of values for $L_T$, $R_T$, P, M:

$$H_{L'} = \begin{bmatrix} \frac{1}{\sqrt{2}} & 0 \\ 1 & 0 \\ \frac{1}{\sqrt{6}} & \frac{-1}{\sqrt{6}} \\ \frac{1}{\sqrt{3}} & 0 \end{bmatrix}$$

$$H_{C'} = \begin{bmatrix} \frac{1}{2} & \frac{1}{2} \\ 0 & \frac{1}{\sqrt{3}} \\ \frac{1}{\sqrt{2}} & \frac{1}{\sqrt{2}} \\ \frac{1}{\sqrt{3}} & 0 \end{bmatrix}$$

$$H_{R'} = \begin{bmatrix} 0 & \frac{1}{\sqrt{2}} \\ 0 & \frac{1}{\sqrt{3}} \\ \frac{-1}{\sqrt{6}} & \frac{1}{\sqrt{6}} \\ 0 & 1 \end{bmatrix}$$

The Q' matrix is constructed in a manner similar to that of matrix Q above. Thus, the four sets of values for $L_T$, $R_T$, P, M are as follows:

1. The magnitudes of $L_T$ and $R_T$ are equal and so are those of P, M. Hence $F_L = F_R = F_C = 1$. The V matrix is [1 1 1 1]. This is known as the unsteered condition since V, contains no directional steering information.

2. $L_T$ is non-zero and $R_T$ is zero, and P, M have equal amplitudes. The may be called steering to the left. The V' matrix is [1 0 1 1].

3. P is non-zero and M is zero. $L_T$, $R_T$ have equal amplitudes. The matrix V, is [1 1 0 1].

4. $R_T$ is non-zero and $L_T$ is zero and P and M have equal amplitudes. This may be called steering to the right. The V' matrix is [1 1 1 0].

The Q' matrix is formed by arranging the four V' matrices placed one on top of the other or as follows:

$$Q' = \begin{bmatrix} 1 & 1 & 1 & 1 \\ 1 & 0 & 1 & 1 \\ 1 & 1 & 0 & 1 \\ 1 & 1 & 1 & 0 \end{bmatrix}$$

Then the G' matrices may be obtained from the equations (12) through (14) where the values of the H' matrices take on the values listed above. Solving for the G' matrices using the above values for Q' and H', the coefficients of the G' matrices may be obtained and are set forth below:

$$G_{L'} = \begin{bmatrix} 0.571 & -0.408 \\ -0.293 & 0 \\ 0.299 & 0.408 \\ 0.130 & 0 \end{bmatrix}$$

$$G_{R'} = \begin{bmatrix} -0.408 & 0.571 \\ 0 & 0.130 \\ 0.408 & 0.299 \\ 0 & -0.293 \end{bmatrix}$$

$$G_{C'} = \begin{bmatrix} 0.284 & 0.284 \\ 0.5 & -0.077 \\ -0.207 & -0.207 \\ -0.077 & 0.5 \end{bmatrix}$$

With the above set of G' matrices, the matrix equations (9)-(11) will enhance the directional properties of the three output channels in accordance with the directional information provided by $L_T$, $R_T$.

As in the case of the four output channel decoder of FIGS. 1-10, various changes to the decoder of FIG. 11 may be made in accordance with FIGS. 5A, 5B, 6, 7A-7D to improve the performance of the decoder of FIG. 11. Since these modifications mainly provide better averaging circuits of the two dominance signals, and since the dominance signals in the decoder of FIG. 11 are essentially the same as those in FIG. 1, the modifications in these later figures may be made to the decoder of FIG. 11 as well.

Figure 12:
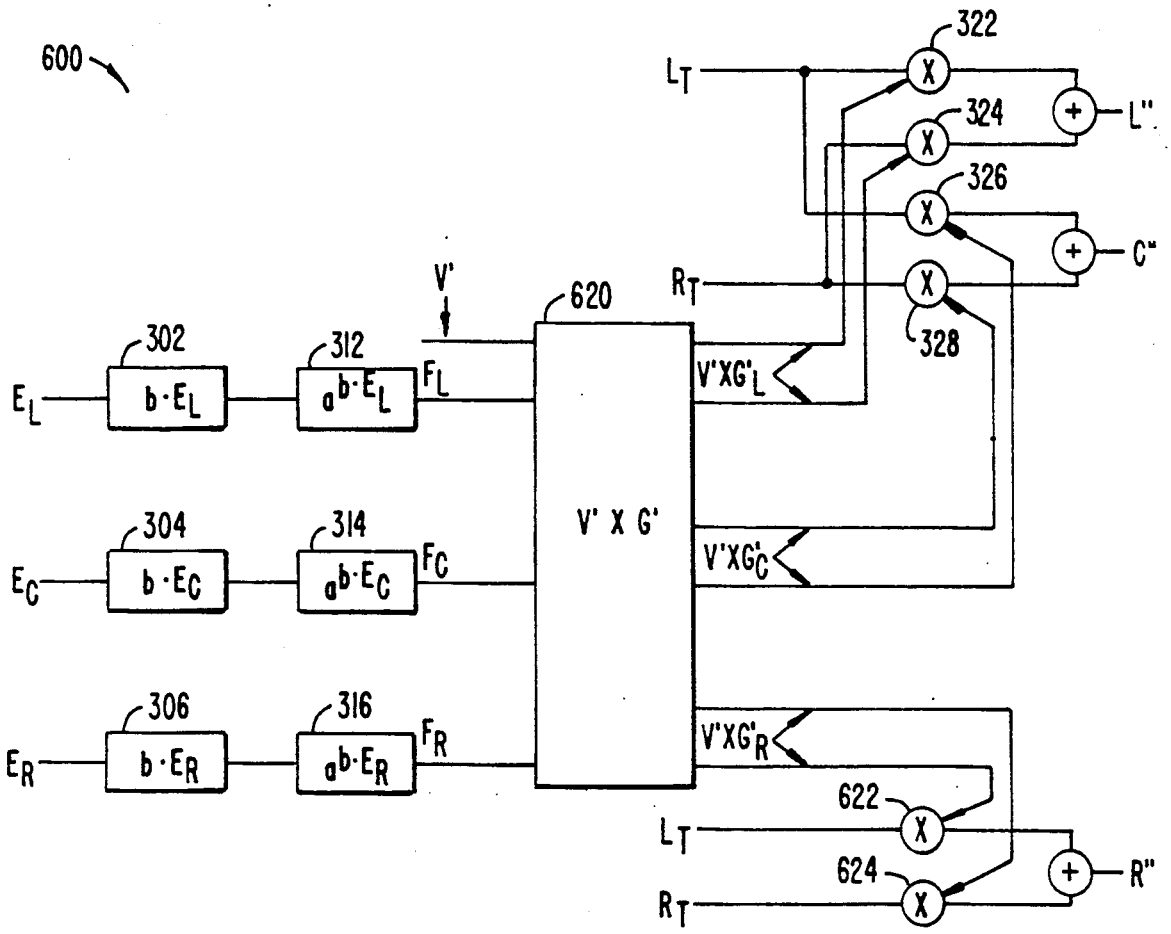
FIG. 12 is a block diagram of a decoder system with four channel outputs where one of the four output channels can be switched between on and off to illustrate the invention.

FIG. 12 is a block diagram of a matrix circuit 600 for a decoder illustrating an alternative embodiment of the invention which is a direct implementation of the matrix equations above. While the matrix circuit 600 of FIG. 12 illustrates more clearly the operation of the invention in the form of the above matrix equations, it is not as advantageous as matrix circuit 500 of FIG. 11 for reasons similar to those explained above for matrix circuits 10 and of FIGS. 1 and 8. In other words, the six multipliers (322-328, 622, 624) are four quadrant 20 multipliers whereas the six multipliers (71, 73-75, 77, 78) of FIG. 11 need only be two quadrant multipliers. The circuit 500 of FIG. 11 achieves some economy in saving components over circuit 600 of FIG. 12.

Figure 13:
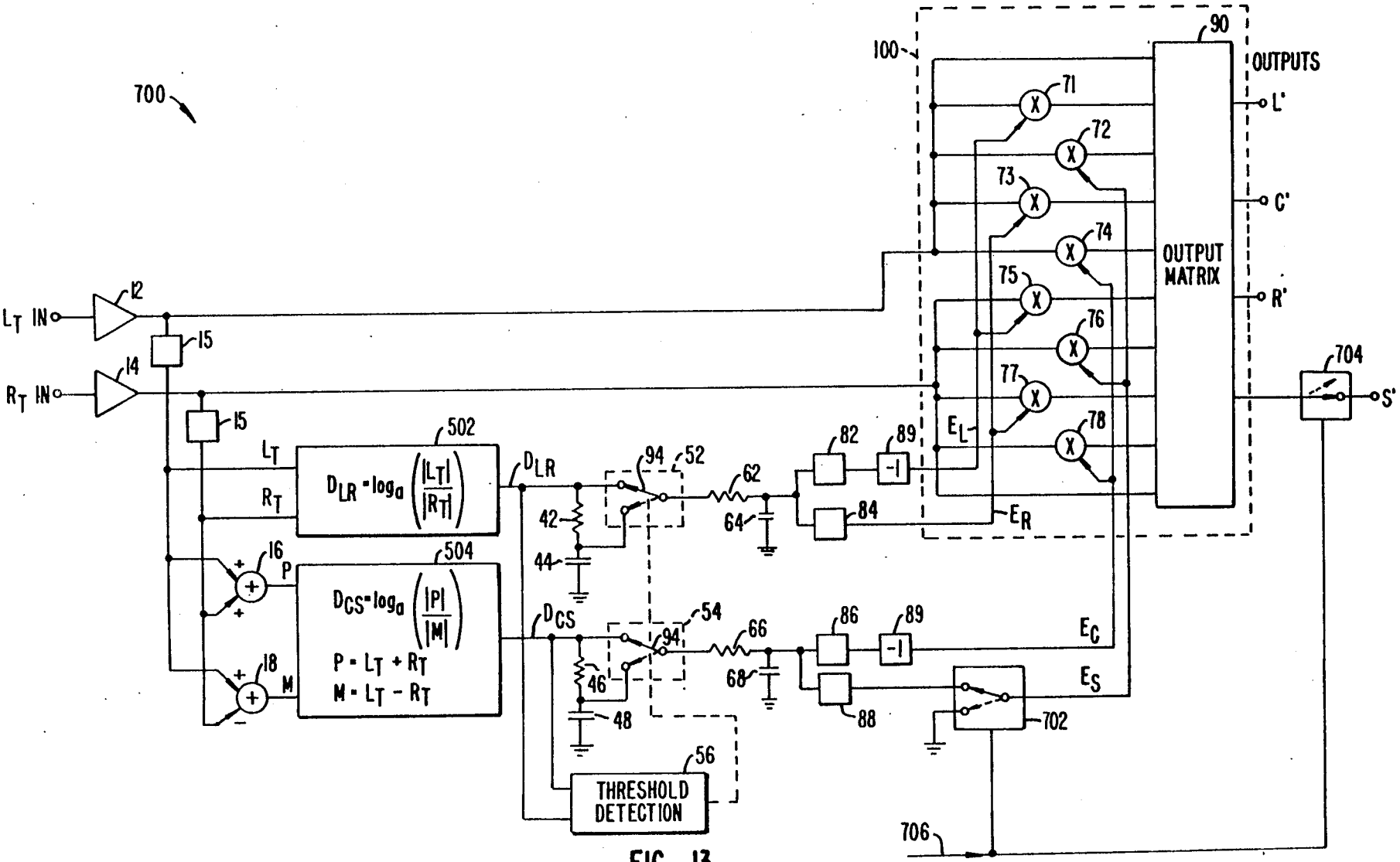
FIG. 13 is a block diagram of a matrix circuit suitable for use in a variable matrix decoder to illustrate an alternative embodiment of the invention.

FIG. 13 is a block diagram of a variable matrix decoder circuit 700 having switches which permits the decoder to have either four output channels or three output channels. Decoder 700 is similar to decoder 10 of FIG. 1 except for the following differences. Again the differential logarithmic converters 502, 504 differ from converters and 24 of FIG. 1 in that the small crosstalk term has been left out. In addition a switch 702 has been included in the connection between rectifier 88 and multiplier 72. Another switch 704 is connected between the output matrix circuit 90 and the output S' of the fourth channel of the decoder output. Both switches 702, 704 are controlled by a line 706 so that signals on line 706 control the two switches. Except for these differences, circuit 700 operates in exactly the same manner as that of circuit 10 of FIG. 1. Hence if matrix decoder 700 is to have four output channels L', C', R', S', the signal on line 706 will cause switches 702, 704 to switch to their solid line positions so that decoder circuit 700 will have exactly the same configuration as that of decoder 10 in FIG. 1. When only three output channels L', C' and R' are desired, the signal on line 706 will cause switches 702, 704 to switch to their dotted line positions, thereby disconnecting the output S' and causing multiplier 72 to be connected to ground instead of to rectifier 88. Then the exponential term $F_S$ will have the value I in the matrix equations (1)-(3) above. When the three output channels are produced in such manner, the three outputs L', C', R' will contain certain constant contributions which would otherwise have gone to the fourth output channel S'. FIG. 8 may be modified in a similar manner to provide a decoder switchable between three and four channels. Switches similar to switches 702, 704 are provided at the $E_S$ input and S' output. When three output channels are desired, the $E_S$ input is switched to ground and output S' is switched off. When four output channels are desired, the $E_S$ signal is applied as in FIG. 8, and output S' is not switched off.

Figure 14:
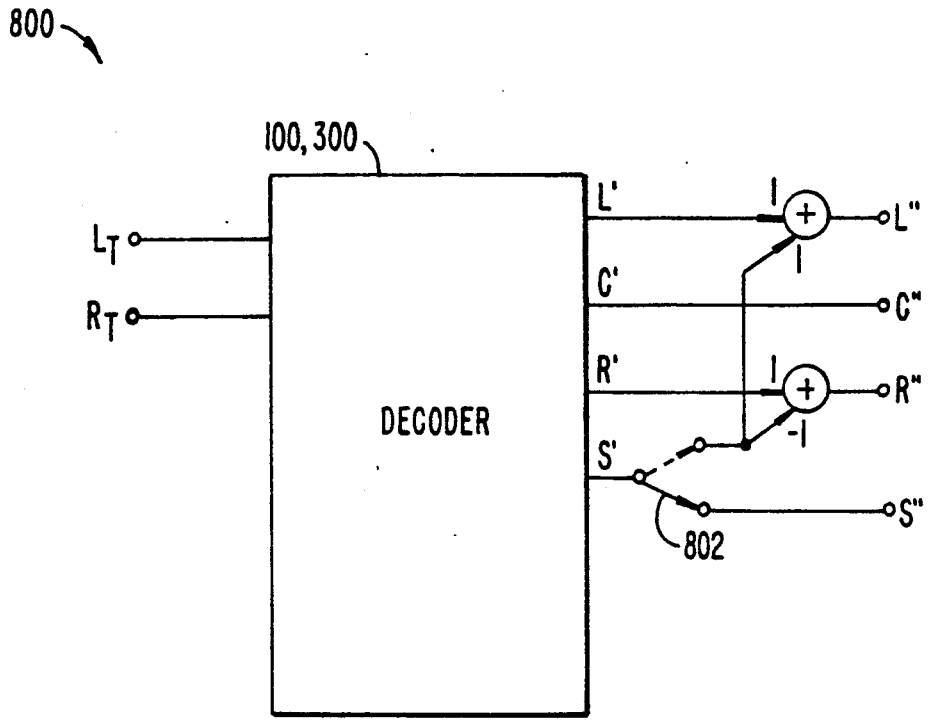
FIG. 14 is a block diagram of a variable matrix decoder to illustrate a second alternative embodiment of the invention.

FIG. 14 is a block diagram of a matrix decoder 800 which converts the four output channels of decoder circuits 100, 300 to three or four outputs through a switching arrangement. Thus, if four output channels are desired, switch 802 is in the solid line position and connects output S' to output S'' of circuit 800 so that the outputs L'', C'', R'', S'' of circuit 800 are exactly the same as output L', C', R', S' of circuit 100 or 300. If only three output channels are desired, switch 102 is switched to the dotted line position so that the output S' of circuit 100 or 300 is added in the same phase to output L' and in opposite phase to output R' to obtain respectively the outputs L'', L'' as shown in FIG. 14.

Figure 15:
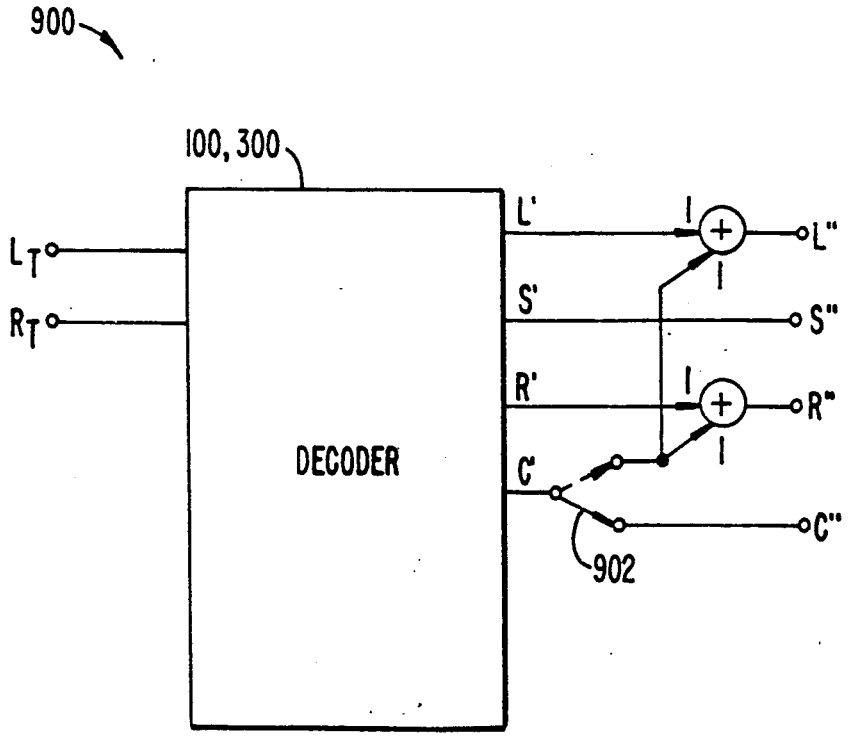
FIG. 15 is a block diagram of a variable matrix decoder to illustrate another aspect of the invention.

FIG. 15 is a block diagram of a variable matrix decoder circuit 900 similar to circuit 800 of FIG. 14 except that the output C'' is now optional instead of the output S'' and in that the output C' of circuit 100, 300 is now added in phase to output L', R' to derive the outputs L'', R'' of circuit 900 when only three outputs L'', R'', S'' are desired. Decoder 900 has the advantage that it provides a realistic approximation of the original sound ) e.g. four channel surround sound) but with only three speakers. Since the central channel is reproduced in left and right channels, a listener sitting more or less equidistant from the left and right channels will also hear a realistic reproduction of the center channel.

The matrix decoding system described in this patent application is useful for improving the perceived directionality of signals containing one or more input channels of information, as compared with conventional two channel reproduction. For example, the two channel signals $L_T$ and $R_T$ may contain identical (monaural) information. With two channel reproduction, this signal will be heard from both speakers, creating a large and unfocussed sound field at most listening positions. With the decoder having L'', R'' and C'' outputs, this signal will be reproduced from the center speaker, giving proper monaural localization for all listeners.

Conventional stereophonic signals may be created with as little as a single pair of microphones, or several separate signals mixed together with independent sound field positions. In either case, use of the additional center channel output of the matrix decoder will improve the localization of sounds in the stereophonic signals, which is especially important for listeners seated off center of the ideal middle listening position.

Finally, when used with multi-channel encoded programs such as in Dolby Surround and Dolby Stereo, the decoder will replicate the spatial performance of the original four channel decoder from which this derives, with the exception that the surround information will be retained in the left and right outputs rather than be directed toward the surround speakers, which do not exist in this example.

The above description of circuit implementation and method is merely illustrative thereof and various changes in arrangements or other details of the method and implementation may be within the scope of the appended claims.

We claim:

1. A decoder for decoding two or more channel signals in a directional information system wherein one or more input signals containing directional information are encoded into the two or more channel signals, said decoder comprising:

first means for generating at least a first dominance signal indicative of the ratio of the amplitudes of said two channel signals;

second means for generating at least a second dominance signal indicative of the ratio of the amplitudes of the sum of and the difference between said two channel signals; and matrix means responsive to said two or more channel signals and to said at least two dominance signals for generating a plurality of output signals for which directional effects of the output signals are enhanced, wherein the first dominance signal $D_{LR}$ and the second dominance signal $D_{CS}$ are given by:

$$D_{LR} = \log_a \frac{|L_T|}{|R_T|}$$

$$D_{CS} = \log_a \frac{|P|}{|M|}$$

where $L_T$, $R_T$ are two channel signals $P=L_T+R_T$, $M=L_T-R_T$, and a is a constant, and wherein said matrix means includes means for deriving three directional control signals $E_L$, $E_R$, $E_C$.

2. The decoder of claim 1, wherein said means for deriving derives the three directional control signals according to the following equations:

$$E_L = \begin{Bmatrix} -D_{LR}; & D_{LR} \geqq 0 \\ 0; & D_{LR} < 0 \end{Bmatrix}$$

$$E_R = \begin{Bmatrix} 0; & D_{LR} \geqq 0 \\ D_{LR}; & D_{LR} < 0 \end{Bmatrix}$$

$$E_C = \begin{Bmatrix} -D_{CS}; & D_{CS} \geqq 0 \\ 0; & D_{CS} < 0 \end{Bmatrix}$$

3. The decoder of claim 1, wherein the matrix means generates the three output signals L', R', C', so that the three signals are defined by means of the equations below:

$$V \times G_L \times \begin{bmatrix} L_T \\ R_T \end{bmatrix} = L'$$

$$V \times G_R \times \begin{bmatrix} L_T \\ R_T \end{bmatrix} = R'$$

$$V \times G_C \times \begin{bmatrix} L_T \\ R_T \end{bmatrix} = C'$$

V is a 1 by 4 matrix $[1, F_L, F_C, F_R]$;

$G_L$, $G_R$, $G_C$ are 4 by 2 matrices of predetermined coefficients; b is a constant and $F_L$, $F_R$, $F_C$ are given by:

$F_L = a_L^{b.E}$ $F_R = a_R^{b.E}$ $F_C = a_C^{b.E}$.

4. The decoder of claim 3, wherein the values of b is about 0.839.

5. The decoder of claim 3, wherein the $G_L$, $G_R$, $G_C$ matrices are as follows:

$$G_L = \begin{bmatrix} 0.571 & -0.408 \\ -0.293 & 0 \\ 0.299 & 0.408 \\ 0.130 & 0 \end{bmatrix}$$

$$G_R = \begin{bmatrix} -0.408 & 0.571 \\ 0 & 0.130 \\ 0.408 & 0.299 \\ 0 & -0.293 \end{bmatrix}$$

$$G_C = \begin{bmatrix} 0.284 & 0.284 \\ 0.5 & -0.077 \\ -0.207 & -0.207 \\ -0.077 & 0.5 \end{bmatrix}$$

6. The decoder of claim 3, wherein the $G_L$, $G_R$, $G_C$ matrices are derived from three equations $Q \times G_L = H_L$, $Q = G_R = H_R$, $Q \times G_C = H_C$, where $$Q = \begin{bmatrix} 1 & 1 & 1 & 1 \\ 1 & 0 & 1 & 1 \\ 1 & 1 & 0 & 1 \\ 1 & 1 & 1 & 0 \end{bmatrix}$$

and $$H_L = \begin{bmatrix} \frac{1}{\sqrt{2}} & 0 \\ 1 & 0 \\ \frac{1}{\sqrt{6}} & \frac{-1}{\sqrt{6}} \\ \frac{1}{\sqrt{3}} & 0 \end{bmatrix}$$

$$H_C = \begin{bmatrix} \frac{1}{2} & \frac{1}{2} \\ 0 & \frac{1}{\sqrt{3}} \\ \frac{1}{\sqrt{2}} & \frac{1}{\sqrt{2}} \\ \frac{1}{\sqrt{3}} & 0 \end{bmatrix}$$

$$H_R = \begin{bmatrix} 0 & \frac{1}{\sqrt{2}} \\ 0 & \frac{1}{\sqrt{3}} \\ \frac{-1}{\sqrt{6}} & \frac{1}{\sqrt{6}} \\ 0 & 1 \end{bmatrix}$$

7. The decoder of claim 3, wherein the matrix means further comprises:

means for generating six product signals wherein each of the product signals is the product of either $L_T$ or $R_T$ with one of 3 signals $F_L$, $F_C$, $F_R$; and means for adding weighed sums of the six product signals to obtain output signals L', C', R'.

8. The decoder of claim 7, wherein said generating means includes six voltage controlled amplifiers for generating the six product signals.

9. The decoder of claim 3, wherein the matrix means further comprises:

means for generating the 3 signals $F_L$, $F_C$, $F_R$ from $E_L$, $E_R$, $E_C$; and means for performing the matrix multiplications $V \times G_L$, $V \times G_R$, $V \times G_C$.

10. The decoder of claim 1, further comprising a threshold detection means for detecting the amplitudes of the dominance signals, an averaging means and a switch, wherein the threshold detection means causes an average value of the dominance signals over a preceding time period to be applied to the matrix means upon detecting that the amplitudes of the dominance signals are below a predetermined threshold, so that the directional enhancements are determined by the average value of the dominance signals.

11. The decoder of claim 1, further comprising an averaging means for applying an average value of the dominance signals over a preceding time period to the matrix means, so that the directional enhancement of the output signals by the matrix means is in accordance with the average value.

12. The decoder of claim 11, wherein the averaging means has two different time constants, one time constant being operative when at least one dominance signal has an amplitude greater than a threshold value and the other time constant being operative when neither of the dominance signals have an amplitude above said threshold value.

13. The decoder of claim 12, wherein said averaging means comprises:

a variable resistor whose resistance varies inversely with the amplitudes of the dominance signals, said resistor connected between the first or second dominance signal generating means and the matrix means; and an impedance means forming a low pass filter configuration with the resistor.

14. The decoder of claim 12, wherein said impedance means comprises:

a first and a second capacitor means connected in series between ground and a first point in the connection between the variable resistor and the matrix means;

a first resistor means forming a charge path for the first capacitor means, the first capacitor means having a capacitance much smaller than that of the second capacitor means so that the voltage across the first capacitor means responds more quickly than that across the second capacitor means to changes in the amplitudes of the dominance signals, so that when dominance signals increase in amplitudes, the averaging means will respond mainly to the voltage across the first capacitor means, thereby enabling the decoder to use the dominance signals to steer the decoder.

15. The decoder of claim 14, said decoder further comprising means for discharging the second capacitor means so that when the amplitudes of both dominance signals decrease to substantially zero, the first capacitor means is discharged through the first resistor means in a much shorter time than the second capacitor means, so that the directional enhancement of the output signals by the matrix means is substantially determined by the voltage across the second capacitor means before the second capacitor means has been discharged, and so that no directional enhancement is applied when the second capacitor means has been substantially discharged.

16. The decoder of claim 13, wherein said Variable resistor is a transconductance amplifier.

17. A method for decoding two or more channel signals in a directional information system wherein one or more input signals containing directional information are encoded into the two or more channel signals, said decoder comprising:

generating at least a first dominance signal indicative of the ratio of the amplitudes of said two channel signals;

generating at least a second dominance signal indicative of the ratio of the amplitudes of the sum of and the difference between said two channel signals; and generating in response to said two or more channel signals and to said at least two dominance signals a plurality of output signals for which directional effects of the output signals are enhanced, wherein the first dominance signal $D_{LR}$ and the second dominance signal $D_{CS}$ are given by:

$$D_{LR} = \log_a \frac{|L_T|}{|R_T|}$$

$$D_{CS} = \log_a \frac{|P|}{|M|}$$

where $L_T$, $R_T$ are two channel signals $P=L_T+R_T$, $M=L_T-R_T$; and a is a constant, and wherein said generating step includes deriving three directional control signals $E_L$, $E_R$, $E_C$.

18. The method of claim 17, wherein said deriving step derives the three directional control signals according to the following equations:

$$E_L = \begin{Bmatrix} -D_{LR}; & D_{LR} \geqq 0 \\ 0; & D_{LR} < 0 \end{Bmatrix}$$

$$E_R = \begin{Bmatrix} 0; & D_{LR} \geqq 0 \\ D_{LR}; & D_{LR} < 0 \end{Bmatrix}$$

$$E_C = \begin{Bmatrix} -D_{CS}; & D_{CS} \geqq 0 \\ 0; & D_{CS} < 0 \end{Bmatrix}$$

19. The method of claim 18, wherein the generating step generates the three output signals L', R', C', so that the three signals are defined by means of the equations below:

$$V \times G_L \times \begin{bmatrix} L_T \\ R_T \end{bmatrix} = L'$$

$$V \times G_R \times \begin{bmatrix} L_T \\ R_T \end{bmatrix} = R'$$

$$V \times G_C \times \begin{bmatrix} L_T \\ R_T \end{bmatrix} = C'$$

V is a 1 by 4 matrix $[1, F_L, F_C, F_R]$;

$G_L$, $G_R$, $G_C$ are 4 by 2 matrices of predetermined coefficients; b is a constant and $F_L$, $F_R$, $F_C$ are given by:

$F_L = a_L^{b.E}$ $F_R = a_R^{b.E}$ $F_C = a_c^{b.E}$.

20. The method of claim 19, wherein the $G_L$, $G_R$, $G_C$ matrices are as follows:

$$G_L = \begin{bmatrix} 0.571 & -0.408 \\ -0.293 & 0 \\ 0.299 & 0.408 \\ 0.130 & 0 \end{bmatrix}$$

-continued $$G_R = \begin{bmatrix} -0.408 & 0.571 \\ 0 & 0.130 \\ 0.408 & 0.299 \\ 0 & -0.293 \end{bmatrix}$$

$$G_C = \begin{bmatrix} 0.284 & 0.284 \\ 0.5 & -0.077 \\ -0.207 & -0.207 \\ -0.077 & 0.5 \end{bmatrix}$$

21. The method of claim 19, wherein the $G_L$, $G_R$, $G_C$ matrices are derived from three equations $Q \times G_L = H_L$, $Q \times G_R = H_R$, $Q \times G_C = H_C$, where $$Q = \begin{bmatrix} 1 & 1 & 1 & 1 \\ 1 & 0 & 1 & 1 \\ 1 & 1 & 0 & 1 \\ 1 & 1 & 1 & 0 \end{bmatrix}$$

and $$H_L = \begin{bmatrix} \frac{1}{\sqrt{2}} & 0 \\ 1 & 0 \\ \frac{1}{\sqrt{6}} & \frac{-1}{\sqrt{6}} \\ \frac{1}{\sqrt{3}} & 0 \end{bmatrix}$$

$$H_C = \begin{bmatrix} \frac{1}{2} & \frac{1}{2} \\ 0 & \frac{1}{\sqrt{3}} \\ \frac{1}{\sqrt{2}} & \frac{1}{\sqrt{2}} \\ \frac{1}{\sqrt{3}} & 0 \end{bmatrix}$$

$$H_R = \begin{bmatrix} 0 & \frac{1}{\sqrt{2}} \\ 0 & \frac{1}{\sqrt{3}} \\ \frac{-1}{\sqrt{6}} & \frac{1}{\sqrt{6}} \\ 0 & 1 \end{bmatrix}$$

22. The method of claim 19, wherein the generating step further comprises:

generating six product signals wherein each of the product signals is the product of either $L_T$ or $R_T$ with one of 3 signals $F_L$, $F_C$, $F_R$; and adding weighted sums of the six product signals to obtain output signals L', C', R'.

23. The method of claim 19, wherein the generating step further comprises:

generating the 3 signals $F_L$, $F_C$, $F_R$ from $E_L$, $E_R$, $E_C$; and performing the matrix multiplications $V \times G_L$, $V \times G_R$, $V \times G_C$.

* * * * *

UNITED STATES PATENT AND TRADEMARK OFFICE

CERTIFICATE OF CORRECTION

PATENT NO. : 5,046,098

DATED : September 3, 1991

INVENTOR(S) : Mandell et al. (D.E. Mandell; C. Todd; R. Dressler)

It is certified that error appears in the above-identified patent and that said Letters Patent is hereby corrected as shown below:

Column 03
Line 17 -- "a" should be --as--
Column 03
Line 47 -- "for the providing" should be --for providing--
Column 05
Line 09 -- "amplitude difference M" should be --amplitude of the sum P of $L_T$, $R_T$ and the amplitude of their difference M--
Column 06
Line 5 '|P" should be --|P|--
Column 10
Line 08 -- "$R_T$ in" should be --$R_T$ present in"
Column 10
Line 52 -- "ay" should be --may--
Column 13
Line 31 -- "comparator" should be --comparators--
Column 17
Line 37 -- "and" should be --an--
Column 18
Line 67 -- "V," should be --V'--
Column 19
Line 02 -- "THE"should be --This--.
Column 19
Line 05 -- "V," should be --V'--
Column 19, line 66 and 67 "four quadrant 20 multipliers" should be --four quadrant multipliers--
Column 20
Line 09 -- "converters and 24" should be --converters 22 and 24--

UNITED STATES PATENT AND TRADEMARK OFFICE

CERTIFICATE OF CORRECTION

PATENT NO. : 5,046,098

DATED : September 3, 1991

INVENTOR(S) : Mandell et al. (D.E. Mandell; C.C. Todd; R. Dressler)

It is certified that error appears in the above-identified patent and that said Letters Patent is hereby corrected as shown below:

Column 20
Line 55 -- "L", L"" should be --L", R"--
Column 20
63 and 64")e.g." should be --(e.g.--.
Column 22
Line 35 -- "V is a 1 by 4" should be --where V is a 1 by 4--
Column 22
LIne 68 -- "Q = $G_R$" should be --Q X $G_R$--

Signed and Sealed this

Ninth Day of March, 1993

*Attest:*

STEPHEN G. KUNIN

*Attesting Officer*

*Acting Commissioner of Patents and Trademarks*